US007717175B2

(12) United States Patent
Chung et al.

(10) Patent No.: US 7,717,175 B2
(45) Date of Patent: May 18, 2010

(54) METHODS OF IMPROVING HEAVY OIL PRODUCTION

(75) Inventors: Bernard Compton Chung, Calgary (CA); Mintu Bose, Calgary (CA); Stewart Allan Morton, Calgary (CA); Kenneth James Elkow, Calgary (CA); Ed Erlendson, Calgary (CA); Frances Lai, Calgary (CA); David Peter Meeks, Cranbrook (CA); Kenneth Myron Oberg, Lloydminster (CA); Louis Chiu-Hung Leung, Calgary (CA); James Nelson Ireland, Lloydminster (CA)

(73) Assignee: Nexen Inc., Calgary (CA)

( * ) Notice: Subject to any disclaimer, the term of this patent is extended or adjusted under 35 U.S.C. 154(b) by 0 days.

(21) Appl. No.: 11/735,261

(22) Filed: Apr. 13, 2007

(65) Prior Publication Data

US 2007/0181299 A1 Aug. 9, 2007

Related U.S. Application Data

(63) Continuation-in-part of application No. 11/049,294, filed on Feb. 3, 2005, now Pat. No. 7,527,096.

(30) Foreign Application Priority Data

Jan. 26, 2005 (CA) ..... 2494391

(51) Int. Cl.
*E21B 43/17* (2006.01)
*E21B 43/24* (2006.01)

(52) U.S. Cl. ..... 166/268; 166/263; 166/272.3

(58) Field of Classification Search ..... 166/245, 166/50, 263, 268, 272.3, 303
See application file for complete search history.

(56) References Cited

U.S. PATENT DOCUMENTS

| | | | |
|---|---|---|---|
| 1,342,781 | A | 6/1920 | Vedder |
| 2,137,167 | A | 11/1938 | Lang |
| 2,923,356 | A | 2/1960 | Glass et al. |
| 3,179,156 | A | 4/1965 | Sharp |
| 3,301,326 | A | 1/1967 | McNamer |

(Continued)

FOREIGN PATENT DOCUMENTS

| | | |
|---|---|---|
| CA | 101565 | 8/1977 |

(Continued)

OTHER PUBLICATIONS

Sawatzky, Ron, "In Situ Recovery methods for Heavy Oil and Bitumen", presented at the 2004 CSEG National Convention, Edmonton, Canada.

(Continued)

*Primary Examiner*—Daniel P Stephenson
(74) *Attorney, Agent, or Firm*—Santosh K. Chan; Blake, Cassels & Graydon LLP

(57) ABSTRACT

The invention provides an improved method for extracting heavy oil or bitumen contained in a reservoir. The invention involves directing the formation of a solvent fluid chamber through the combination of directed solvent fluid injection and production at combinations of horizontal and/or vertical injection wells so as to increase the recovery of heavy oil or bitumen contained in a reservoir. The wells are preferably provided with flow control devices to achieve uniform production.

25 Claims, 11 Drawing Sheets

U.S. PATENT DOCUMENTS

| | | | |
|---|---|---|---|
| 3,559,737 | A | 2/1971 | Ralstin |
| 3,794,114 | A | 2/1974 | Brandon |
| 3,989,108 | A | 11/1976 | Allen |
| 4,026,358 | A | 5/1977 | Allen |
| 4,099,568 | A | 7/1978 | Allen |
| 4,324,291 | A | 4/1982 | Wong et al. |
| 4,509,596 | A | 4/1985 | Emery |
| 4,577,691 | A | 3/1986 | Huang et al. |
| 4,610,304 | A | 9/1986 | Doscher |
| 4,682,652 | A | 7/1987 | Huang et al. |
| 4,700,779 | A | 10/1987 | Huang et al. |
| 4,718,485 | A | 1/1988 | Brown et al. |
| 4,785,882 | A | 11/1988 | Sprunt |
| 4,794,987 | A | 1/1989 | Kokolis et al. |
| 4,821,801 | A | 4/1989 | Van Laar |
| 4,832,122 | A | 5/1989 | Corey et al. |
| 4,834,179 | A | 5/1989 | Kokolis et al. |
| 4,850,429 | A | 7/1989 | Mims et al. |
| 4,858,691 | A | 8/1989 | Ilfrey et al. |
| 5,060,730 | A | 10/1991 | Kisman et al. |
| 5,062,483 | A | 11/1991 | Kisman et al. |
| 5,065,821 | A | 11/1991 | Huang et al. |
| 5,244,041 | A | 9/1993 | Renard et al. |
| 5,273,111 | A | 12/1993 | Brannan et al. |
| 5,407,009 | A | 4/1995 | Butler et al. |
| 5,607,016 | A | 3/1997 | Butler |
| 5,860,475 | A | 1/1999 | Ejiogu et al. |
| 5,899,274 | A | 5/1999 | Frauenfeld et al. |
| 6,016,873 | A | 1/2000 | Hsu et al. |
| 6,095,344 | A | 8/2000 | White |
| 6,119,776 | A | 9/2000 | Graham et al. |
| 6,257,334 | B1 | 7/2001 | Cyr et al. |
| 6,318,464 | B1 | 11/2001 | Mokrys |
| 6,318,465 | B1 | 11/2001 | Coon et al. |
| 6,474,413 | B1 | 11/2002 | Barbosa et al. |
| 6,619,396 | B1 | 9/2003 | Kimoto et al. |
| 6,662,872 | B2 | 12/2003 | Gutek et al. |
| 2006/0048942 | A1 | 3/2006 | Moen et al. |

FOREIGN PATENT DOCUMENTS

| | | | |
|---|---|---|---|
| CA | 1018058 | | 9/1977 |
| CA | 1059432 | | 7/1979 |
| CA | 1239088 | | 7/1988 |
| CA | 2015460 | | 12/1993 |
| CA | 2018952 | | 11/1994 |
| CA | 2015459 | | 8/1995 |
| CA | 2018951 | | 3/1996 |
| CA | 2108349 | | 8/1996 |
| EP | 0588421 | B1 | 11/1999 |
| GB | 2169018 | A | 7/1986 |
| WO | WO 02/075110 | A1 | 9/2002 |
| WO | WO 2004/018837 | A1 | 3/2004 |

OTHER PUBLICATIONS

Squires, Andrew. "Inter-well Tracer Results and Gel Blocking Program", presented at the Tenth Annual Clearwater Reservoir, Elk Point, Alberta, Canada Mar. 9, 1993.

Butler, R. M.; Jiang, Q "Improved Recovery of Heavy Oil by Vapex with Widely Spaced Horizontal Injectors and Producers" *Journal of Canadian Petroleum Technology*, Jan. 2000, vol. 39, No. 1.

Butler, R. M. ; Mokrys, I. J., "Recovery of Heavy Oils Using Vaporized Hydrocarbon Solvents: Further Development of the Vapex Process", *Journal of Canadian Petroleum Technology*, Jun. 1993, vol. 32, No. 6.

Morkey, Igor J.; Butler, Roger M., The Rise of Interfering Solvent Chambers: Solvent Analog Model of Steam-Assisted Gravity Drainage, *Journal of Canadian Petroleum Technology*, Mar. 1993, vol. 32, No. 3.

Butler, R. M. ; Mokrys, I. J., "Closed-loop Extraction Method for the Recovery fo Heavy Oils and Bitumens Underlain by Aquifers: the Vapex Process", *Journal of Canadian Petroleum Technology*, Apr. 1998, vol. 37, No. 4.

METHODS OF IMPROVING HEAVY OIL PRODUCTION

CROSS REFERENCE TO PRIOR APPLICATIONS

This application is a Continuation in Part of U.S. patent application Ser. No. 11/049,294, filed Feb. 3, 2005, which claims priority from Canadian patent application number 2,494,391 filed on Jan. 26, 2005. The contents of such prior applications are incorporated herein by reference in their entirety.

FIELD OF THE INVENTION

The present invention is directed to oil extraction processes used in the recovery of hydrocarbons from hydrocarbon deposits.

BACKGROUND OF THE INVENTION

There exist throughout the world deposits or reservoirs of heavy oils and bitumen which, until recently, have been ignored as sources of petroleum products since the contents thereof were not recoverable using previously known production techniques. While those deposits that occur near the surface may be exploited by surface mining, a significant amount of heavy oil and bitumen reserves may occur in formations that are too deep for surface mining, typically referred to as "in situ" reservoirs or deposits because extraction must occur in situ or from within the reservoir or deposit. The recovery of heavy oil and/or bitumen in these in situ deposits may be hampered by the physical characteristics of the heavy oil and bitumen contained therein, particularly the viscosity of the heavy oil and/or bitumen. While there is no clear definition, heavy oil typically has a viscosity of greater than 100 mPas (100 cP), a specific gravity of 10° API to 17° API and tends to be mobile (e.g. capable of flow under gravity) under reservoir conditions, while bitumen typically has a viscosity of greater than 10,000 mPas (10,000 cP), a specific gravity of 7° API to 10° API and tends to be immobile (e.g. incapable of flow under gravity) under reservoir conditions. The above noted physical characteristics of the heavy oil and bitumen (collectively referred to as "heavy oil") typically render these components difficult to recover from in situ deposits and, as such, in situ processes and/or technologies specific to these types of deposits are needed to efficiently exploit these resources.

Several techniques have been developed to recover heavy oil from in situ deposits, such as steam assisted gravity drainage (SAGD), as well as variations thereof using hydrocarbon solvents (e.g. VAPEX), steam flooding, cyclic steam stimulation (CSS) and in-situ combustion. These techniques involve attempts to reduce the viscosity of the heavy oil so that the heavy oil and bitumen can be mobilized toward production wells. One such method, SAGD, provides for steam injection and oil production to be carried out through separate wells. The SAGD configuration provides for an injector well which is substantially parallel to, and situated above a producer well, which lies horizontally near the bottom of the deposit. Thermal communication between the two wells is established, and as oil is mobilized and produced from the producer or production well, a steam chamber develops. Oil at the surface of the enlarging steam chamber is constantly mobilized by contact with steam and drains under the influence of gravity.

An alternative to SAGD, known as VAPEX, provides for the use of hydrocarbon solvents rather than steam. A hydrocarbon solvent or mixture of solvents such as propane, butane, ethane and the like can be injected into the reservoir or deposit through an injector well. Solvent fluid at the solvent fluid/oil interface dissolves in the heavy oil thereby decreasing its viscosity, causing the reduced or decreased viscosity heavy oil to flow under gravity to the production well. The hydrocarbon vapour forms a solvent fluid chamber, analogous to the steam chamber of SAGD.

It has been recognized, however, that these prior means used for the recovery of heavy oil from subterranean deposits need to be optimized.

SUMMARY OF THE INVENTION

An aspect of the present invention includes a method for extracting hydrocarbons from in a reservoir containing hydrocarbons having an array of wells disposed therein, the method comprising: (a) injecting a solvent fluid into the reservoir through a first well in the array; (b) producing reservoir fluid from a second well in the array, the second well offset from the first well, to drive the formation of a solvent fluid chamber between the first and the second well; (c) injecting the solvent fluid into the solvent fluid chamber through at least one of the first and second wells to expand the solvent fluid chamber within the reservoir; and (d) producing reservoir fluid from at least one well in the array to direct the expansion of the solvent fluid chamber within the reservoir.

An aspect of the present invention includes a method for extracting hydrocarbons from a reservoir containing hydrocarbons, the method comprising: (a) injecting a solvent fluid into the reservoir through a first well disposed in the reservoir; (b) producing reservoir fluid from a second well disposed in the reservoir and offset from the first well to create a pressure differential between the first and second well, the pressure differential being sufficient to overcome the gravity force of the solvent fluid so as to drive the formation of a solvent fluid chamber towards the second well.

Another aspect of the present invention includes a method for extracting hydrocarbons from a reservoir containing hydrocarbons, the method comprising: (a) injecting a solvent fluid into the reservoir through a first well disposed in the deposit; (b) producing reservoir fluid from a second well disposed in the reservoir and offset from the first well so as to drive the formation of a solvent fluid chamber towards the second well until solvent fluid breakthrough occurs at the second well; (c) injecting the solvent fluid into the solvent fluid chamber through the second well to increase the surface area of the solvent fluid chamber; and (d) producing reservoir fluid in the solvent fluid chamber from the first well.

Another aspect of the present invention includes a method for extracting hydrocarbons from a reservoir containing hydrocarbons, the method comprising: (a) injecting a solvent fluid into the reservoir through a first vertical well disposed in the deposit; (b) producing reservoir fluid from a second vertical well disposed in the reservoir offset from the first vertical well so as to drive the formation of a first solvent fluid chamber towards the second vertical well until solvent fluid breakthrough occurs at the second vertical well; (c) injecting the solvent fluid into the reservoir through a first horizontal well disposed in the deposit and offset from the first and second vertical wells so as to create a second solvent fluid chamber; and (d) producing reservoir fluid from the horizontal well and injecting solvent fluid into the first solvent chamber so as to drive the first solvent fluid chamber towards the second solvent fluid chamber. In a further aspect, the horizontal well may include completion and production strings. In another aspect, the completion string may be provided with flow control devices as described further herein.

Another aspect of the present invention includes a method for extracting hydrocarbons from a reservoir containing hydrocarbons, the method comprising: (a) injecting a solvent fluid into the reservoir through a first well disposed in the reservoir; (b) producing reservoir fluid from a second well disposed in the reservoir and offset from the first well to create a direct solvent fluid channel between the first and second well; (c) injecting solvent fluid into the reservoir from at least one of the first and second wells and producing reservoir fluid from at least one of the first and second wells to create at least two solvent fluid chambers, each of the solvent fluid chambers having "oil/solvent fluid" mixing and "solvent fluid/oil mixing".

In one aspect the present invention provides a method for extracting hydrocarbons from a reservoir having at least one well, the method comprising injecting a solvent fluid into the reservoir through the well and extracting a reservoir fluid from the at least one well.

In one aspect the present invention provides a method for extracting hydrocarbons from a reservoir having at least one well, the at least one well having at least one completion string disposed therein, the method comprising injecting a solvent fluid into the reservoir through the at least one completion string and extracting a reservoir fluid from the at least one well.

In one aspect the present invention provides a method for extracting hydrocarbons from a reservoir having at least one well, the at least one well having at least one completion string disposed therein, the method comprising injecting a solvent fluid into the reservoir through the at least one completion string and extracting a reservoir fluid from the at least one well, wherein the at least one completion string includes two or more flow control devices located on a portion thereof in the reservoir.

In one aspect the present invention provides a method for extracting hydrocarbons from a reservoir having at least one well, the at least one well having at least one completion string and at least one production string disposed therein, the method comprising injecting a solvent fluid into the reservoir through the at least one completion string and extracting a reservoir fluid from the reservoir through the at least one completion string and extracting the reservoir fluid from the at least one well through the at least one production string.

In one aspect the present invention provides a method for extracting hydrocarbons from a reservoir having at least one well, the at least one well having at least one completion string and at least one production string disposed therein, the method comprising injecting a solvent fluid into the reservoir through the at least one completion string and extracting a reservoir fluid from the reservoir through the at least one completion string and extracting the reservoir fluid from the at least one well through the at least one production string, wherein the at least one completion string includes two or more flow control devices located on a portion thereof in the reservoir.

In one aspect the present invention provides a method for extracting hydrocarbons from a reservoir, comprising at least one first well and at least one second well, the method comprising injecting a solvent fluid into the reservoir through the at least one first well and extracting a reservoir fluid from the at least one second well.

In one aspect the present invention provides a method for extracting hydrocarbons from a reservoir, comprising at least one first well and at least one second well, the at least one first well having at least one completion string disposed therein, the method comprising injecting a solvent fluid into the reservoir through the at least one completion string and extracting a reservoir fluid from at least one of the wells.

In one aspect the present invention provides a method for extracting hydrocarbons from a reservoir, comprising at least one first well and at least one second well, the at least one first well having at least one completion string disposed therein, the method comprising injecting a solvent fluid into the reservoir through the at least one completion string and extracting a reservoir fluid from at least one of the wells, wherein the at least one completion string includes two or more flow control devices located on a portion thereof in the reservoir.

In one aspect the present invention provides a method for extracting hydrocarbons from a reservoir, comprising at least one first well and at least one second well, the at least one first well having at least one completion string and at least one production string disposed therein, the method comprising injecting a solvent fluid into the reservoir through at least one of the completion strings and the second wells and extracting a reservoir fluid from at least one of the completion strings and the second wells and extracting the reservoir fluid from the at least one first well through the at least one production string.

In one aspect the present invention provides a method for extracting hydrocarbons from a reservoir, comprising at least one first well and at least one second well, the at least one first well having at least one completion string and at least one production string disposed therein, the method comprising injecting a solvent fluid into the reservoir through the at least one first completion string and the at least one second well and extracting a reservoir fluid from the reservoir from at least one of the completion strings and the second wells and extracting the reservoir fluid from the at least one of the at least one production string or second well, wherein at least one of the completion strings includes two or more flow control devices located on a portion thereof in the reservoir.

In one aspect the present invention provides a method for extracting hydrocarbons from a reservoir, comprising at least one first well and at least one second well, the at least one first well having at least one first completion string disposed therein, the at least one second well having at least one second completion string disposed therein, the method comprising injecting a solvent fluid into the reservoir through at least one of the completion strings and extracting a reservoir fluid from at least one of the wells, wherein at least one of the completion strings includes two or more flow control devices located on a portion thereof in the reservoir.

In one aspect the present invention provides a method for extracting hydrocarbons from a reservoir, comprising at least one first well and at least one second well, the at least one first well having at least one first completion string and at least one first production string disposed therein, the at least one second well having at least one second completion string disposed therein, the method comprising injecting a solvent fluid into the reservoir through at least one of the completion strings and extracting a reservoir fluid from the reservoir from at least one of the first completion strings and the second wells and extracting the reservoir fluid from the at least one first well through the at least one production string or the at least one second well, wherein at least one of the completion strings includes two or more flow control devices located on a portion thereof in the reservoir.

In one aspect the present invention provides a method for extracting hydrocarbons from a reservoir, comprising at least one first well and at least one second well, the at least one first well having at least one first completion string and at least one first production string disposed therein, the at least one second well having at least one second completion string and at least one second production string disposed therein, the method comprising injecting a solvent fluid into the reservoir through at least one of the completion strings and extracting a reservoir fluid from the reservoir from at least one of the completion strings and extracting the reservoir fluid from at least one of the first and second wells through at least one of the first or second production strings, wherein at least one of the completion strings includes two or more flow control devices located on a portion thereof in the reservoir.

In a further aspect, the present invention includes a method for extracting hydrocarbons from a reservoir having at least one first well and at least one second well, the at least one first well having at least one first completion string and at least one first production string disposed therein, and the at least one second well having at least one second completion string and at least one second production string disposed therein, the method comprising: (a) injecting a solvent fluid into the reservoir through at least one of the completion strings; (b) extracting reservoir fluid from the reservoir from at least one of the completion strings, wherein the at least one second well is offset from the at least one first welt, to drive the formation of a solvent fluid chamber between the at least one first well and the at least one second well; (c) injecting the solvent fluid into the solvent fluid chamber through at least one of the completion strings to expand the solvent fluid chamber within the reservoir; (d) extracting reservoir fluid from the reservoir from at least one of the completion strings to direct the expansion of the solvent fluid chamber within the reservoir, and (e) extracting the reservoir fluid from at least one of the first and second wells through at least one of the first or second production strings, wherein at least one of the completion strings includes two or more flow control devices located on a portion thereof in the reservoir.

In a further aspect, the present invention includes a method for extracting hydrocarbons from a reservoir having at least one first well and at least one second well, the at least one first well having at least one first completion string and at least one first production string disposed therein, and the second well having at least one second completion string and at least one second production string disposed therein, the method comprising: (a) injecting a solvent fluid into the reservoir through the at least one of the completion strings disposed in the reservoir; (b) extracting reservoir fluid from the at least one of the completion strings disposed in the reservoir, the at least one second well being offset from the at least one first well to create a pressure differential between the at least one first and the at least one second well, the pressure differential being sufficient to overcome the gravity force of the solvent fluid so as to drive the formation of a solvent fluid chamber towards the at least one second well; and (c) extracting the reservoir fluid from at least one of the first and second wells through at least one of the first or second production strings, wherein at least one of the completion strings includes two or more flow control devices located on a portion thereof in the reservoir.

In a further aspect, the present invention includes a method for extracting hydrocarbons from a reservoir having at least one first well and at least one second well, the at least one first well having at least one first completion string and at least one first production string disposed therein, and the at least one second well having at least one second completion string and at least one second production string disposed therein, the method comprising: (a) injecting a solvent fluid into the reservoir through at least one of the completion strings disposed in the reservoir; (b) extracting reservoir fluid from the reservoir from at least one of the completion strings disposed in the reservoir, the at least one second well being offset from the at least one first well so as to drive the formation of a solvent fluid chamber towards the at least one second well until solvent fluid breakthrough occurs at the at least one second well; (c) injecting the solvent fluid into the solvent fluid chamber through at least one of the completion strings to increase the surface area of the solvent fluid chamber; (d) producing reservoir fluid from the solvent fluid chamber in the reservoir using at least one of the completion strings; and (e) extracting the reservoir fluid from at least one of the first and second wells through at least one of the first or second production strings, wherein at least one of the completion strings includes two or more flow control devices located on a portion thereof in the reservoir.

In a further aspect the present invention includes a method for extracting hydrocarbons from a reservoir having at least one first well and at least one second well, the at least one first well having at least one first completion string and at least one first production string disposed therein, and the at least one second well having at least one second completion string and at least one second production string disposed therein, the method comprising: (a) injecting a solvent fluid into the reservoir through at least one of the completion strings disposed in the reservoir; (b) extracting reservoir fluid from the reservoir from at least one of the completion strings disposed in the reservoir, the at least one second well being offset from the at least one first well to create a direct solvent fluid channel between the at least one first and the at least one second well; (c) injecting solvent fluid into the reservoir from at least one of the completion strings; (d) producing reservoir fluid from the reservoir using at least one of the completion strings to create at least two solvent fluid chambers, each of the solvent fluid chambers having "oil/solvent fluid" mixing and "solvent fluid/oil mixing", and (e) extracting the reservoir fluid from at least one of the first and second wells through at least one of the first or second production strings, wherein at least one of the completion strings includes two or more flow control devices located on a portion thereof in the reservoir.

In a further aspect, the present invention includes a method for extracting hydrocarbons from a reservoir having at least one first well and at least one second well, the at least one first well having at least one first completion string and at least one first production string disposed therein, and the at least one second well having at least one second completion string and at least one second production string disposed therein, the method comprising: (a) injecting a solvent fluid into the reservoir through at least one of the completion strings disposed in the reservoir; (b) extracting reservoir fluid from the reservoir from at least one of the completion strings disposed in the reservoir, the at least one second well being vertically and laterally offset from the at least one first well so as to drive the formation of a solvent fluid chamber towards the at least one second well until solvent fluid breakthrough occurs at the at least one second well; (c) injecting the solvent fluid into the solvent fluid chamber through at least one of the completion strings to increase the surface area of the solvent fluid chamber; (d) producing reservoir fluid from the solvent fluid chamber in the reservoir using at least one of the completion strings; and (e) extracting the reservoir fluid from at least one of the first and second wells through at least one of the first or second production strings, wherein at least one of the completion strings includes two or more flow control devices located on a portion thereof in the reservoir.

In a further aspect the present invention includes a method for extracting hydrocarbons from a reservoir having at least one first well and at least one second well, the at least one first well having at least one first completion string and at least one first production string disposed therein, and the at least one second well having at least one second completion string and at least one second production string disposed therein, the method comprising: (a) injecting a solvent fluid into the reservoir through at least one of the completion strings disposed in the reservoir; (b) extracting reservoir fluid from the reservoir from at least one of the completion strings disposed in the reservoir, the at least one second well being vertically and laterally offset from the at least one first well to create a direct solvent fluid channel between the at least one first and the at least one second well; (c) injecting solvent fluid into the reservoir from at least one of the completion strings; (d) producing reservoir fluid from the reservoir using at least one of the completion strings to create at least two solvent fluid chambers, each of the solvent fluid chambers having "oil/solvent fluid" mixing and "solvent fluid/oil mixing", and (e) extracting the reservoir fluid from at least one of the first and second wells through at least one of the first or second production strings, wherein at least one of the completion strings includes two or more flow control devices located on a portion thereof in the reservoir.

BRIEF DESCRIPTION OF THE DRAWINGS

Various objects, features and attendant advantages of the present invention will become more fully appreciated and better understood when considered in conjunction with the accompanying drawings, in which like reference characters designate the same or similar parts throughout the several views.

DETAILED DESCRIPTION OF THE INVENTION

Figure 1A:
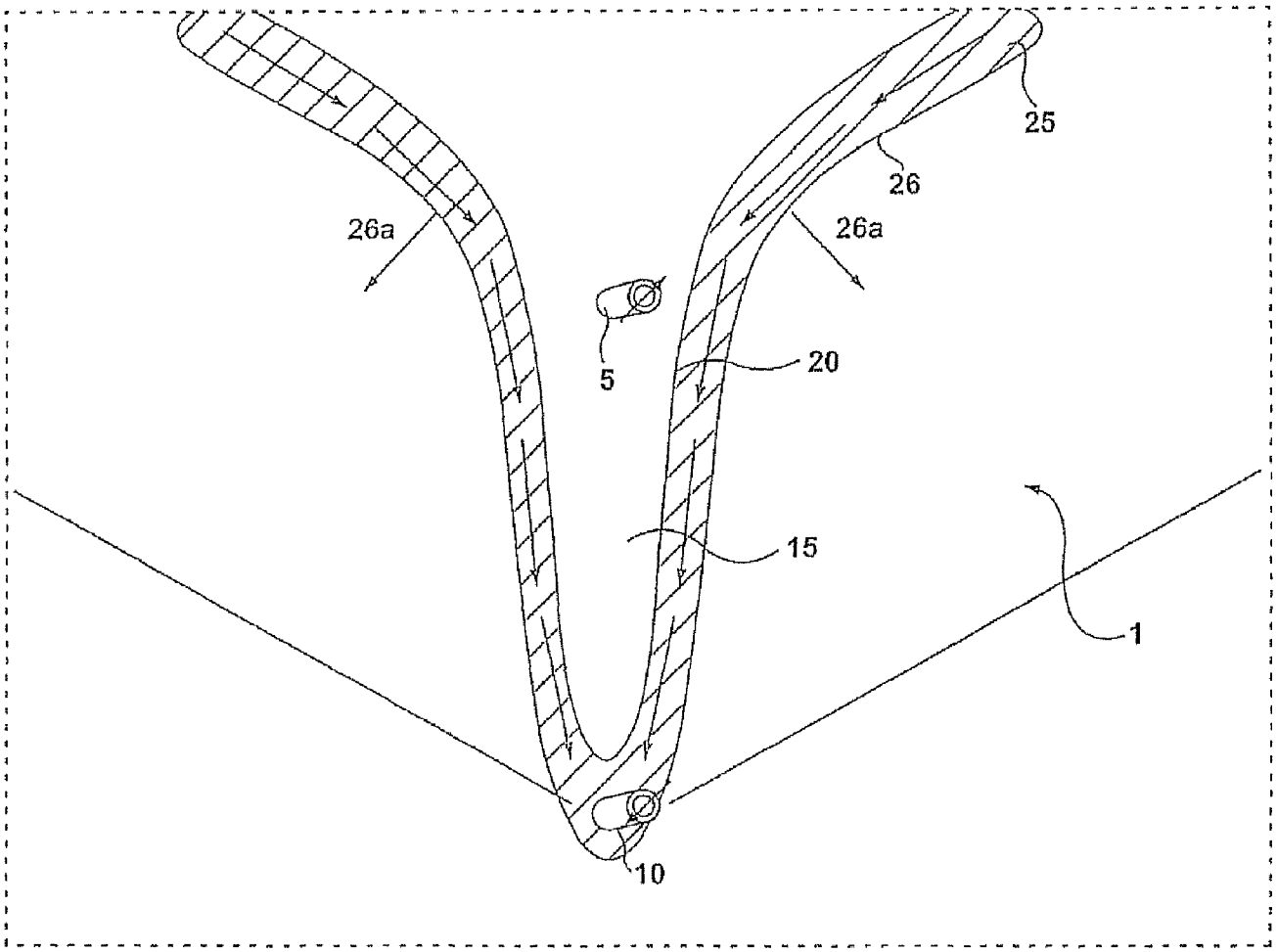
FIG. 1a (Prior Art)
FIGS. 1(*a*) and (*b*) are schematic perspective views of an array of horizontal wells.

In order that the invention may be more fully understood, it will now be described, by way of example, with reference to the accompanying drawings in which FIGS. 1 through 7 illustrate embodiments of the present invention.

In the description and drawings herein, and unless noted otherwise, the terms "vertical", "lateral" and "horizontal", can be references to a Cartesian co-ordinate system in which the vertical direction generally extends in an "up and down" orientation from bottom to top while the lateral direction generally extends in a "left to right" or "side to side" orientation. In addition, the horizontal direction generally extends in an orientation that is extending out from or into the page. Alternatively, the terms "horizontal" and "vertical" can be used to describe the orientation of a well within a reservoir or deposit. "Horizontal" wells are generally oriented parallel to or along a horizontal axis of a reservoir or deposit. The horizontal axis and thus the so-called "horizontal wells" may correspond to or be parallel to the horizontal, vertical or lateral direction as represented in the description and drawings. "Vertical" wells are generally oriented perpendicular to horizontal wells and are generally parallel to the vertical axis of the reservoir. As with the horizontal axis, the vertical axis and thus the so-called "vertical wells" may correspond to or be parallel to the horizontal, vertical or lateral direction as represented in the description and drawings. It will be understood that horizontal wells are generally 80° to 105° relative to the vertical axis of the reservoir or deposit, while vertical wells are generally perpendicular relative to the horizontal axis of the reservoir or deposit.

Many known methods of heavy oil recovery or production employ means of reducing the viscosity of the heavy oil located in the deposit so that the heavy oil will more readily flow under reservoir conditions to the production wells. Steam or solvent fluid flooding of the reservoir to produce a steam or solvent fluid chamber in SAGD and VAPEX processes may be used to reduce the viscosity of the heavy oil within the deposit. While a SAGD process reduces the viscosity of the heavy oil within the deposit through heat transfer, a VAPEX process reduces the viscosity by dissolution of the solvent into the heavy oil. Such techniques show potential for stimulating recovery of heavy oil that would otherwise be essentially unrecoverable. While these processes, particularly VAPEX, may potentially increase heavy oil production, these known processes may not sufficiently maximize recovery of the heavy oil so that the in situ deposit can be produced in an economically or cost efficient or effective manner. The objective of embodiments of the present invention is to improve recovery of heavy oil in these in-situ deposits so as to effectively, efficiently, and economically maximize heavy oil recovery. The embodiments of the present invention are directed to the use of a solvent fluid, which may consist of a solvent in a liquid or gaseous state or a mixture of gas and liquid, so as to effectively and efficiently maximize oil recovery by increasing the mixing process of the solvent fluid (e.g. either a solvent liquid or solvent fluid) with the heavy oil contained in the formation, thus improving the oil recovery from particular underground hydrocarbon formations.

The present invention is directed to producing a solvent fluid chamber having a desired configuration or geometry between at least two wells. In an aspect of the present invention, a solvent fluid chamber having a desired configuration or geometry is formed between one well that may be vertically, horizontally or laterally offset from another well so as to maximize the recovery of heavy oil from in-situ deposits. It will be understood by a person skilled in the art that the use of the term "offset" herein refers to wells that can be displaced relative to one another within the reservoir or deposit in a lateral, horizontal or vertical orientation. The solvent fluid may comprise steam, methane, butane, ethane, propane, pentanes, hexanes, heptanes, carbon dioxide ($CO_2$) or other solvent fluids which are well known in the art, either alone or in combination, as well as these solvent fluids or mixtures thereof mixed with other non-condensable gases. The solvent fluid (e.g. solvent liquid, gas or mixtures thereof) chamber configuration of the present invention provides for an increase in the surface area of the solvent fluid chamber that is in contact with heavy oil contained within the deposit. The increased contact between the fluid chamber and the heavy oil leads to increased mixing between the fluid (e.g. solvent liquid, gas or mixtures thereof) and the heavy oil. The increased mixing, in turn, leads to increased production of the heavy oil from a producing well. The fluid that is "produced" or flows into the producing well, typically in a liquid state, from within the deposit to the surface or elsewhere where it is collected typically comprises reduced or decreased viscosity heavy oil, solvent fluid, other components or mixtures thereof. This mixture of reduced viscosity heavy oil and other components has a viscosity less than that of heavy oil, namely 1 to 100 cP, and can be referred to as "decreased viscosity heavy oil", "reduced viscosity heavy oil" or "production oil". As noted above, heavy oil, namely heavy oil and bitumen have viscosities of between 100 to 5,000,000 cP.

Figure 1B:
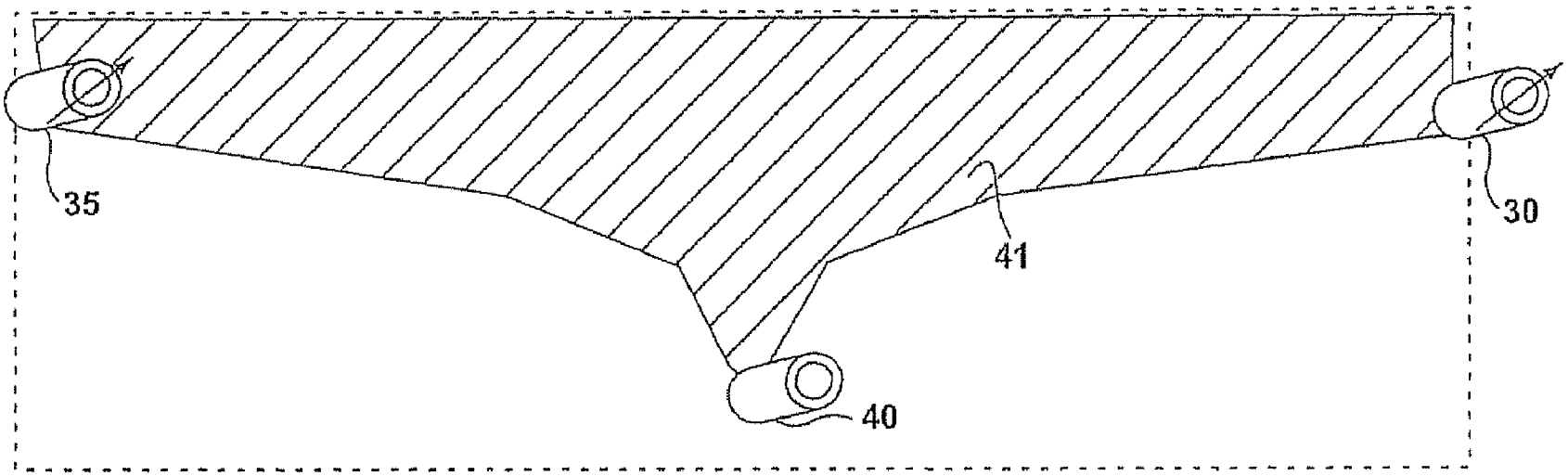

FIGS. 1(*a*) and 1(*b*) of the present application show an example of a known configuration of at least one injector well and one production well in a heavy oil deposit 1. As shown in FIG. 1(*a*), two vertically offset horizontal wells 5 and 10 are provided. These can be previously existing horizontal wells that may have been drilled for primary production or newly drilled wells for secondary production processes such as SAGD or VAPEX. Well 5 can be used to inject a solvent fluid, such as steam, propane, methane, etc., into deposit 1 so as to create a solvent fluid chamber 15 having an outer edge 20. Outer edge 20 has a given surface area that is in contact with the heavy oil of the deposit. The fluid along the surface area of the outer edge 20 of the fluid chamber 15 interfaces with the heavy oil contained within the deposit. If the fluid is a solvent fluid such as methane, propane, etc., the solvent fluid at the surface area of the solvent fluid chamber will mix with the heavy oil along the surface area of the fluid chamber through known mechanisms such as diffusion, dispersion, capillary mixing, etc. This "fluid over oil" surface area mixing between the solvent fluid and the heavy oil of the deposit will result in a decrease in the viscosity of the heavy oil located near outer edge 20. It will be understood that the term "fluid over oil" surface area mixing refers to the type of mixing that occurs when the fluid of the fluid chamber mixes into the heavy oil of the deposit by only diffusion, dispersion, capillary mixing, etc. and is unaided by the effects of gravity, and will be understood in greater detail below. At some point during the "fluid over oil" surface area mixing, the viscosity of the heavy oil along the surface area of the solvent fluid chamber will have been decreased sufficiently to form decreased viscosity heavy oil which will begin to flow to the production well 10 under the influence of gravity as indicated by the arrows provided in FIG. 1(*a*). If steam is used as the solvent fluid, it will be understood that while the steam per se does not mix with the heavy oil along the surface area, the heat of the steam will penetrate the heavy oil so as to decrease the viscosity of the heavy oil so as to begin or increase its flow under gravity. As a result of the mixing (such as, for example, if a solvent fluid is used in a gaseous state) or the heat transfer (such as, for example, if steam is used as the solvent fluid), a volume 25 along the horizontal well length of decreased viscosity oil having an outer edge 26 is formed allowing the improved viscosity heavy oil within area 25 to flow by gravity into production well 10 in the direction provided in the arrows of FIG. 1(*a*). As more solvent fluid or steam is injected into chamber 15 from well 5, fluid chamber 15 will begin to expand in the direction of arrows 26*a* to mix with the heavy oil contained in the deposit. As such, the outer edge or border 26 of mixed heavy oil and solvent fluid or steam will migrate or move through the deposit as the steam or gas mixes with the high viscosity heavy oil. In turn, the lower viscosity heavy oil and solvent fluid mixture will flow via gravity to the production well 10 thus reducing the overall amount of heavy oil in the deposit 1.

Similar to the configuration of FIG. 1(*a*), FIG. 1(*b*) provides three offset horizontal wells, two of which can be considered upper wells 30 and 35, laterally offset from one another, while the remaining well could be considered a lower well 40, laterally and vertically offset from upper wells 30 and 35. Similar to the process discussed in relation to FIG. 1(*a*), FIG. 1(*b*) provides that a solvent fluid is injected into the upper wells 30 and 35 to form a fluid chamber 41 such that the heavy oil either mixes with the solvent fluid (e.g. in the case of the methane, etc.) or receives the heat of the solvent fluid thereby decreasing or reducing the viscosity of the heavy oil which then flows under the influence of gravity to producing well 40.

In the prior art examples provided in FIGS. 1(*a*) and (*b*), it will be understood that the production of heavy oil from production wells 10 and 40 are limited by (a) the rate at which the decreased viscosity heavy oil or production oil flows under gravity to the production well (the "gravity drainage rate"); or (b) the rate of mixing of the solvent fluid within the solvent fluid chamber and the heavy oil contained within the reservoir or deposit (hereinafter referred to as the "solvent fluid/oil mixing rate"). Provided that the gravity drainage rate is not the rate limiting factor under reservoir conditions, the production of decreased viscosity heavy oil or production oil will generally be determined by the amount of decreased viscosity heavy oil or production oil, that has a viscosity sufficiently low to flow under gravity to the production well. This in turn will be dependent upon the solvent fluid/oil mixing rate. The solvent fluid/oil mixing rate is influenced by the surface area of the solvent fluid chamber through which the heavy oil and the solvent fluid of the solvent fluid chamber can interact and by any mechanisms which lead to mixing of the heavy oil and the solvent fluid. In other words, if there is an increase in the surface area of the solvent fluid chamber so as to increase the solvent fluid/oil contact area, the solvent fluid/oil mixing rate will increase. In addition, any mechanisms which can lead to increased oil and solvent fluid mixing will increase the solvent fluid/oil mixing rate which in turn leads to an increase in the production of decreased viscosity heavy oil (i.e. production oil) from the reservoir. In order to maximize production from the producing well, it is desirable, therefore, to maximize the solvent fluid/oil mixing rate.

The present invention is directed, therefore, to maximizing the solvent fluid/oil mixing rate by increasing the surface area mixing of the solvent fluid in the solvent fluid chamber with the heavy oil of the deposit through directing the creation and maintenance of a solvent fluid chamber having a desired configuration or geometry. The solvent fluid chamber of the present invention has an increased surface area over solvent fluid chambers created using previously known methods of heavy oil production such as SAGD and VAPEX. Embodiments of the present invention provide for the use of horizontal or vertical production/injection wells as well as combinations thereof to direct and/or maintain the formation of a solvent fluid chamber having a geometry or configuration so as to maximize the solvent fluid/oil mixing rate by increasing the surface area mixing of the solvent fluid in the solvent fluid chamber with the heavy oil. The embodiments of the present invention involve directing and maintaining the creation or development of a solvent fluid chamber having a desired geometry or configuration between offset horizontal or vertical injection and production wells through the use of simultaneous solvent fluid injection and reservoir fluid production between the offset wells and alternating injection and production between them.

In accordance with the present invention, a solvent fluid chamber having the desired geometry or configuration can be formed between two vertically, horizontally or laterally offset wells so as to provide for increased mixing of the solvent fluid and heavy oil. The wells of the present invention could be either generally vertical or generally horizontal wells or combinations thereof. The solvent fluid chamber of the present invention increases the mixing of the solvent fluid within the solvent fluid chamber and the heavy oil of the deposit by providing increased surface area of the solvent fluid chamber, which provides for both "fluid over oil" mixing and "oil over fluid" mixing. "Fluid over oil" mixing is discussed above in relation to FIGS. 1(*a*) and 1(*b*). It will be understood that "oil over fluid" mixing refers to the mixing that occurs when the solvent fluid of the solvent fluid chamber lies underneath the heavy oil of the deposit. In other words, it will be understood that at least a portion of the surface area of the solvent fluid chamber is disposed vertically below the heavy oil in the deposit. As a result of this configuration, the mixing of the heavy oil and the solvent fluid within the solvent fluid chamber will be increased relative to those chambers which provide predominately "fluid over oil" mixing. In "fluid over oil" mixing, the solvent fluid mixes with the heavy oil under known mechanisms such as diffusion, dispersion, capillary mixing, etc. However, with "oil over fluid" surface area mixing there is an additional mixing force at work, namely gravity. As the solvent fluid of the solvent fluid chamber typically has a lower density or is "lighter" than the heavy oil within the deposit, the fluid will tend to be influenced to migrate into the heavy oil due to its buoyancy. This method of mixing could be described as gravity induced counter-flow mixing of upper heavier oil with a lower lighter solvent fluid. Also, the heavy oil above the solvent fluid will also be influenced to migrate into the fluid chamber due to its higher density. In effect, the mixing of the solvent fluid and the heavy oil is increased due to the effect of the migration tendency of the solvent fluid into the heavy oil and vice versa. As a result, the solvent fluid chamber of the present invention increases the fluid/oil mixing rate due to the increases in surface area and the increases in overall mixing rate due to the additional mixing of oil over fluid mixing not present in prior art methods of heavy oil production.

Solvent Fluid Chamber Creation Using Horizontal Wells

In one embodiment, a solvent fluid is injected into the well via the annulus. In a preferred embodiment, the solvent fluid is injected into the reservoir via a completion string.

In one embodiment, the wells may comprise one or more completion strings, wherein the one or more completion strings may include two or more flow control devices, located on a portion of the completion strings in the reservoir, for a uniform injection of the solvent fluid into the reservoir and uniform production of reservoir fluid from the reservoir.

Figure 2:
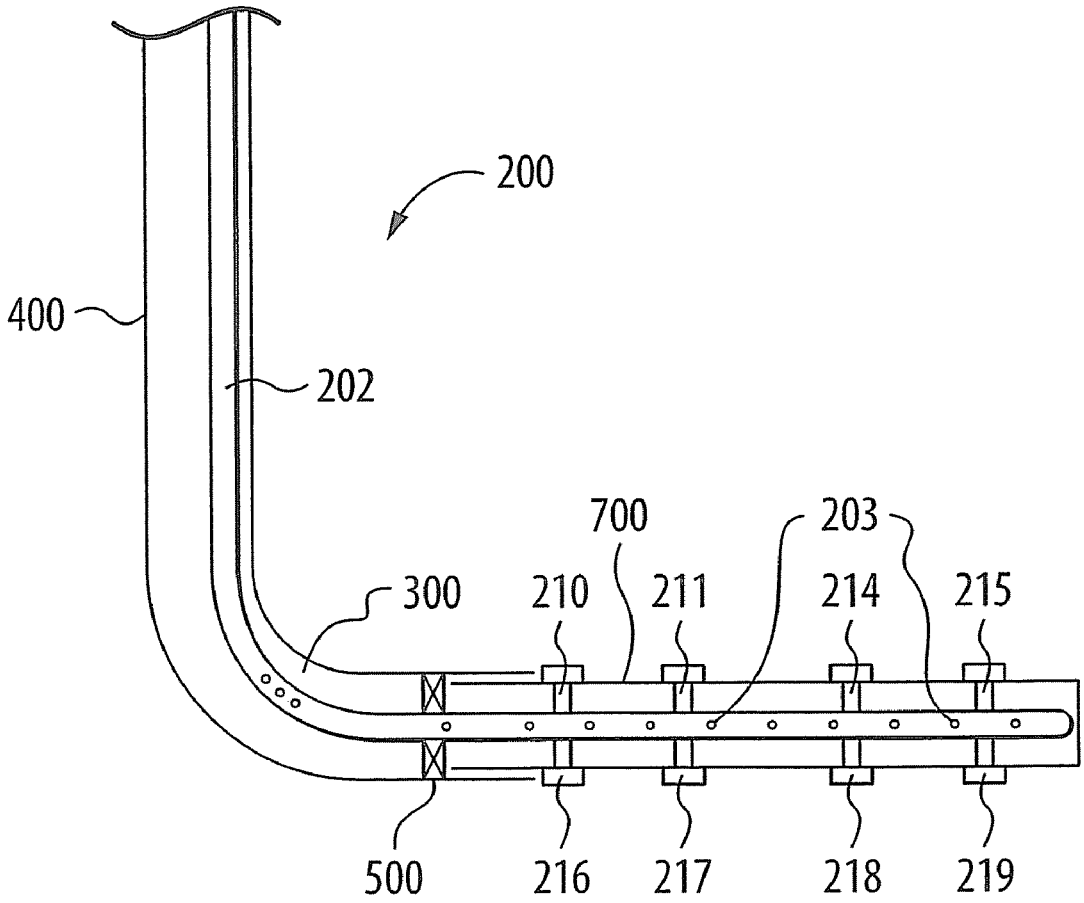
FIG. 2 is a schematic side view of a horizontal well, comprising a completion string with a plurality of flow control devices.

Referring to FIG. 2, a capped well 200 is shown comprising an annulus 300 defined by a well casing 400. The well 200 is provided with an annulus dividing means 500 that separates a portion of a completion string 202 located in the reservoir from a portion of the completion string located outside of the reservoir and of the casing annulus 300. The portion of the completion string located in the reservoir is provided with at least two flow control devices 203. Annular isolation means 210, 211, 214 and 215 are also provided for the zonal isolation of a portion of the completion string located in the reservoir. The annular isolation means are located internally of the horizontal well casing 700. Preferably, the annular isolation means are aligned with packers 216, 217, 218 and 219 located externally of the horizontal well casing 700.

Preferably the horizontal well casing is provided with a reticulated liner to prevent the ingress of particulate matter from the reservoir. The reticulated liner may be a slotted liner or a sand screen of the type known to those of skill in the art.

In use, solvent fluid is injected through the completion string into the reservoir. The solvent fluid passes through the at least two flow control devices 203. The solvent fluid enters the reservoir by flowing through the reticulated liner to initiate and develop a solvent fluid chamber in the reservoir.

The completion string in accordance with the present invention is also suitable for extracting reservoir fluid from a reservoir. Reservoir fluid flows into the completion string 202, through the reticulated liner and at least two flow control devices 203. The reservoir fluid is then pumped out of the well through the completion string.

Figure 3:
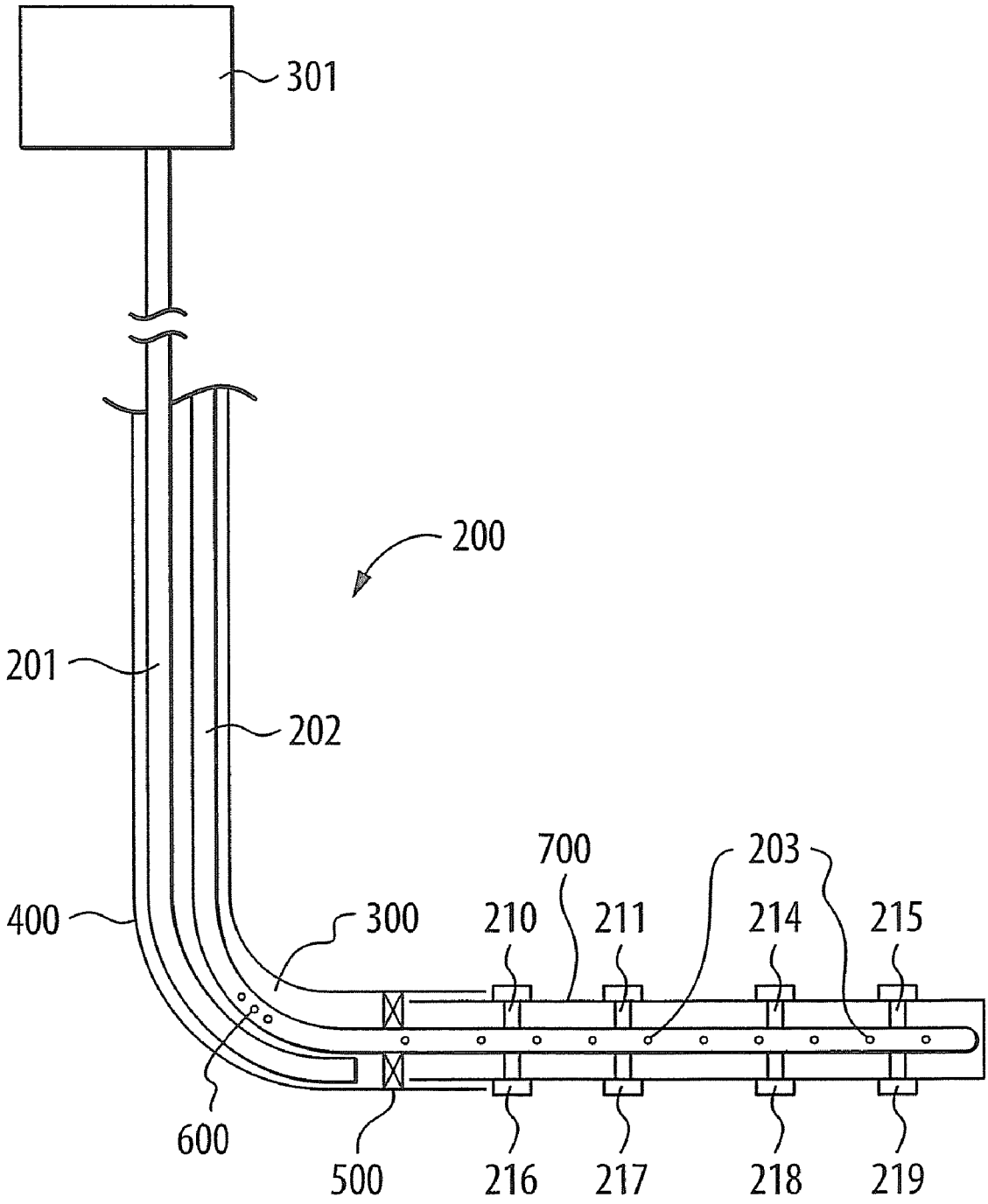
FIG. 3 is a schematic side view of a horizontal well, comprising a production string and a completion string having a plurality of flow control devices.
Figure 4:
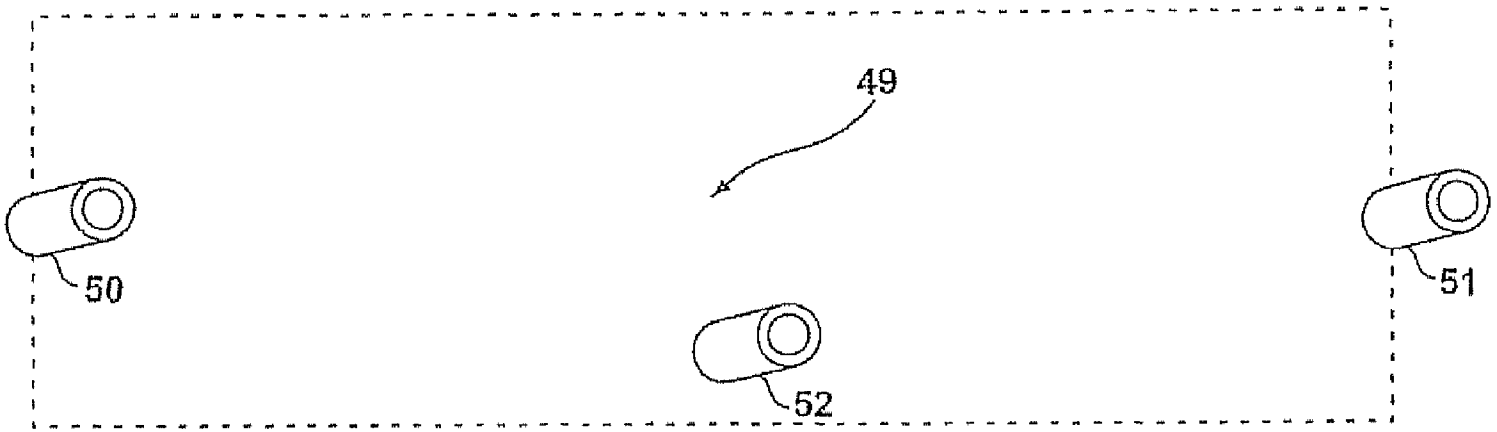
FIGS. 4 and 5 are schematic perspective views of horizontal wells for use with embodiments of the present invention.

Referring to FIG. 3, a preferred embodiment of the present invention is shown. The well 200 further comprises a production string 201. The completion string further comprises flow means 600 to permit fluid communication between the completion string 202, the annulus 300 and the production string 201.

Optionally, the production string may be provided with a pump 301.

In one embodiment, solvent fluid may be injected into the reservoir through the completion string. During this injection some of the solvent fluid may escape from the completion string 202 into the annulus 300 via the flow means 600. However, as the well may be capped and may be under pressure, such fluid escape may be limited. The solvent fluid then passes through the flow control devices 203. The solvent fluid enters the reservoir by flowing through the reticulated liner to initiate and develop a solvent fluid chamber in the reservoir.

In another embodiment, solvent fluid may be injected through the annulus 300 of the well 200. When the well 200 is capped, solvent will flow from the annulus 300 into the injection string 202 via flow means 600. The solvent fluid then passes through the flow control devices 203. The solvent fluid enters the reservoir by flowing through the reticulated liner to initiate and develop a solvent fluid chamber in the reservoir.

The completion string in accordance with the present invention is also suitable for extracting reservoir fluid from a reservoir. Reservoir fluid flows into the completion string 202, through the reticulated liner and flow control devices 203. The reservoir fluid then flows through the portion of the completion string located in the reservoir. The reservoir fluid then exits the completion string through the flow means 600 into the annulus of the well. The annulus dividing means prevents the reservoir fluid from re-entering the portion of the well located in the reservoir. The reservoir fluid in the annulus in then extracted from the well through the production string, using pump 301, if required.

This arrangement is advantageous as it permits the uniform injection of solvent fluid into a reservoir and the uniform production of reservoir fluid from a reservoir.

As will be understood by persons skilled in the art, the arrangement in accordance with the present invention is advantageous as, during fluid injection, when the injection fluid is flowing through the injection string, the fluid may be subjected to flow friction, which results in a frictional pressure loss, particularly when flowing through a horizontal section of an injection string.

This pressure loss normally exhibits a non-linear and increasing pressure loss along the injection string. Thus, the outflow rate of the solvent fluid into the reservoir will also be non-linear and may decrease in the downstream direction of the injection string. At any position along a horizontal injection string, for example, the driving pressure difference (differential pressure) between the fluid pressure within the injection string and the fluid pressure within the reservoir rock may exhibit a non-linear and greatly decreasing pressure progression. Thereby, the radial outflow rate of the injection fluid per unit of horizontal length will be substantially greater at the upstream "heel" portion of the horizontal section than that of the downstream "toe" portion of the well. Thus, the fluid injection rate along the injection string thereby becomes irregular. This causes substantially larger amounts of fluid to be pumped into the reservoir at the "heel" portion of the well than that the "toe" portion of the well.

Accordingly, the solvent fluid will flow out of the horizontal section of the well and spread out within the reservoir as an irregular, non-uniform (inhomogeneous) and partly unpredictable injection front, inasmuch as the injection front drives reservoir fluids towards one or more production wells.

An uneven injection rate may also occur as a result of non-homogeneity within the reservoir. That part of the reservoir having the highest permeability will receive most fluid. This may also create an irregular flood front, and the fluid injection thus becomes non-optimal with respect to downstream recovery from production wells.

Thus, the present arrangement of two or more flow control devices enables a uniform and relatively straight-line injection front to be achieved, moving through the reservoir and pushing the reservoir fluid in front of it.

Advantageously, the arrangement of the present invention also provides for the uniform production of reservoir fluid along the length of a horizontal well.

As will be appreciated by those of skill in the art, when reservoir fluid flows downstream and onwards in the horizontal section of a completion string, said fluid is subjected to flow friction in the form of a frictional pressure drop. In the downstream direction, this frictional pressure drop normally exhibits a non-linear and strongly increasing pressure drop gradient, particularly where this pressure drop gradient occurs largely as a result of the continual draining of new volumes of reservoir fluid into and along the production tubing downstream of said horizontal section. Thus, the flow rate of the fluids increases in the downstream direction. As a result of said pressure drop gradient, the internal fluid flow in the completion string will therefore exhibit a non-linear and greatly decreasing fluid pressure gradient in the downstream direction. When reservoir fluid extraction from a reservoir is started, the fluid pressure in the surrounding reservoir rock will often be relatively homogenous and change very little along the horizontal section. At the same time, the frictional pressure drop of the fluids when flowing from the reservoir rock and radially into the completion string is small in comparison with the frictional pressure drop of the fluids in and along the horizontal section of the well. At any position along this horizontal section, the pressure difference (differential pressure) that arises between the fluid pressure in the reservoir rock and the corresponding fluid pressure inside the production tubing will therefore exhibit a non-linear and strongly increasing differential pressure gradient. In practice, such a differential pressure gradient allows the radial inflow rate of the fluid per unit length of the horizontal section to be significantly greater at the downstream side (the "heel" portion of the well) than at the upstream side (the "toe" portion of the well) of the horizontal section.

When producing hydrocarbons via a horizontal well, the radial inflow rate per unit length of the horizontal section is significantly greater in some reservoir zones than in other zones of the same reservoir, and that said former zones are drained significantly faster than the latter zones. For most horizontal wells, this means that most of the hydrocarbon production is produced from the reservoir zones at the downstream side of the horizontal section, i.e. at the "heel" portion of the well, while relatively small volumes of hydrocarbons are produced from zones along the remaining part of the horizontal section, and in particular from the upstream side of the horizontal section, i.e. the "toe" portion of the well. This leads to some reservoir zones being produced faster than other zones of the reservoir. Fluid flow produced from the fast draining zones may, at an earlier point than is desired, contain large unwanted amounts of solvent fluid. This variable production rate from the various zones of the reservoir also cause differences in fluid pressure between the reservoir zones, which may also lead to the formation fluids flowing among other things into and along an annulus between the outside of the completion string and the borehole wall of the well, instead of flowing inside said completion string.

Thus, the present arrangement of two or more flow control devices, together with annular isolation means advantageously enables a uniform production of reservoir fluid along the length of the completion string located in the reservoir in addition to the uniform injection of solvent fluid.

Of course, it will be further appreciated by those of skill in the art that, in connection with a horizontal well, it may also be desirable to create an injection front having a geometric shape that is, for example, curvilinear, arched or askew. Thereby, it is possible, using the arrangement of the present invention to better adjust, control or shape the injection front relative to the specific reservoir conditions and to the positions of other wells.

In one embodiment, the two or more flow control devices may be disposed in a housing enclosing the completion string.

In one embodiment, the two or more flow control devices may have a diameter greater than 1 mm. In a further embodiment, the two or more flow control devices may have a diameter of about 2 to 5 mm. It will be appreciated by those of skill in the art that such diameters are not intended to be construed as limiting the invention in any way. Various other diameters may be used depending upon various process and equipment configurations.

In yet a further embodiment, the two or more flow control devices may be located at varying distances along the portion of the injection string 202 located in the reservoir. It will be appreciated by those of skill in the art that the location of the flow control devices will vary considerably from well to well depending on such factors as local geology and the like. In another embodiment, the two or more flow control devices may be located at regular intervals along the portion of the injection string located in the reservoir. In still a further embodiment, high densities of flow control devices may be located at certain intervals along the injection string to maximise injection and extraction of fluid into and out of the well. In still a further embodiment, a flow control device may be provided at every joint of the injection string. Preferably, this may be every 13.5 meters. It will be appreciated by those of skill in the art that such distances are not intended to be construed as limiting the invention in any way. Various other distances may be used depending upon various process and equipment configurations.

In another embodiment, the two or more flow control devices may be arranged to have varying diameters along the length of the well, as is generally known to those of skill in the art, in order to provide a uniform distribution of the solvent fluid into the reservoir. In another embodiment, the two or more flow control devices may be arranged such that flow control devices of smaller diameter are found upstream of the well, whilst flow control devices of larger diameter are found downstream of the well. This arrangement provides a gradient of varying flow control device diameters along the length of the well. In another embodiment, the density of the two or more flow control devices may be increased, while at the same time maintaining a constant diameter of the two or more flow control devices. It will be appreciated by those skilled in the art that other arrangements of flow control devices are not excluded from the present invention.

In one embodiment, the flow control devices may be inserts that are inserted into bores located in the completion string, that are of complementary configuration to the inserts. Alternatively, in another embodiment, the flow control devices may comprise an adjustable sleeve or ball valve. The sleeves or ball valves may be adjusted electrically, hydraulically or electro-hydraulically.

In one embodiment, the annulus isolation means may be provided by packers that are generally known to those of skill in the art. In a further embodiment, these packers may be expandable packers. The expandable packers may expand in the presence of liquid hydrocarbons or water and provide zonal isolation of oil producing zones in the wells. It will be appreciated, by those of skill in the art, that although four packers are shown, fewer or greater numbers of these packers may be used. It will be further appreciated that other packers, generally known to those of skill in the art, may be used.

It is a further advantage of the present invention that the use of annulus isolation means enables discrete inflow and outflow zones of solvent fluid from the completion string. This may prevent unwanted cross- or transverse flows of solvent fluid in the annulus during injection. Preferably, each outflow zone may be provided with a configuration of flow control devices immediately prior to lowering and installing the completion string in the well. This is advantageous, as much of the reservoir and well information is often acquired immediately prior to installing a completion string. Thus, an optimal pressure profile for the solvent fluid along the completion string may be calculated immediately prior to installing the string in the well. The arrangement of annular isolation means together with the two or more flow control devices enables uniform injection and production profiles to be obtained.

Preferably, the completion string may also be used as a logging string for the collection of data from the well relating to, for example, temperature, pressure and flow rates.

In a preferred embodiment, the arrangement of the present invention is particularly useful for extracting reservoir fluid from reservoirs comprising angled or diagonal solvent fluid chambers, where at least one first well is vertically and laterally offset from at least one second well.

As shown in FIGS. 4 to 7, wells 50 and 51 may comprise a well arrangement generally known to those of skill in the art. Preferably, wells 50 and 51 may comprise a well arrangement as set forth in FIG. 2. Most preferably, wells 50 and 51 may comprise a well arrangement as set forth in FIG. 3. Well 52 may comprise an arrangement as set forth in FIG. 3 described above. One embodiment of the present invention provides for the creation of a solvent fluid chamber between horizontal wells vertically and laterally offset from one another. As provided in FIGS. 6 and 7, horizontal wells 50 and 51 can be drilled generally parallel to one another and generally parallel to the longitudinal axis of reservoir or deposit 49 in an upper portion of in situ reservoir or deposit 49 having heavy oil contained therein. In FIGS. 4 to 7, the longitudinal axis of deposit 49 would be extending outwardly from the page, e.g. in a horizontal orientation, towards the viewer. Horizontal well 52 can also be infill drilled so as to be offset vertically and laterally from horizontal wells 50 and 51. It will be understood that existing wells from previous production of in situ deposit 49, which may have been previously drilled, may also be used. For example, horizontal wells 50, 51 or 52 may have been used in primary production of deposit 49.

Figure 5:
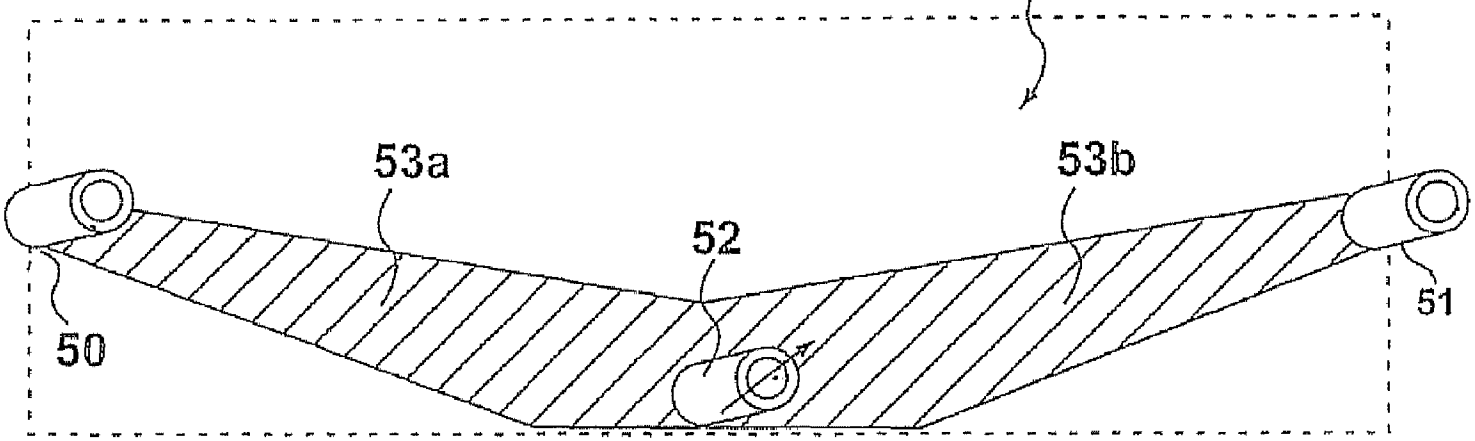

As shown in FIG. 5, solvent fluid (such as methane, propane, etc.) can be injected into horizontal well 52 while "reservoir fluid", which can consist of one or more of decreased viscosity heavy oil (e.g. production oil), water, pre-existing formation gas (e.g. natural gas) or solvent fluid is produced from horizontal wells 50 and 51. Production at horizontal wells 50 and 51 continues until a significant amount (i.e. greater than 50%) of the reservoir fluid produced at wells 50 and 51 is solvent fluid. In other words, as production proceeds at wells 50 and 51, the percentage of solvent fluid of the total reservoir fluid produced will increase, while the percentage of the other components of the reservoir fluid produced will decrease. When the percentage of the solvent fluid is generally greater than 50% of the solvent fluid produced relative to the total reservoir fluid produced, significant solvent fluid "breakthrough" has occurred. As production proceeds at well 50 while solvent fluid is simultaneously injected into deposit 49 via well 52, a solvent fluid chamber 53*a* will be created (see FIG. 5) that is oriented away from well 52 towards well 50. In general, and as shown in FIG. 5, the solvent fluid chamber is delimited by upper and lower upwardly inclined boundaries. The upper and lower upwardly inclined boundaries converge towards well 50. Solvent fluid chamber 53*a* may, for the purposes of illustration in FIG. 5 and not to be considered limiting, have a generally elongated wedge shape with the apex generally oriented towards well 50 and the elongated base oriented towards and extending along the horizontal length of well 52. The volume of the elongated wedge base is generally largest nearest the injection well (e.g. well 50 in FIG. 5) as this area tends to have the highest volume of solvent fluid. As the process described herein proceeds, the solvent fluid chamber will continue to expand as more solvent fluid is injected. It will be understood however, that the specific configuration or geometry of solvent fluid chamber 53*a* will be dictated by reservoir conditions and by the injection and production procedures as described herein. Similarly, as production proceeds at well 51 while solvent fluid is injected into deposit 49 via well 52, a second solvent fluid chamber 53*b*, similar in configuration and geometry to solvent fluid chamber 53*a* as noted above, will be created.

As shown in FIG. 5, each of solvent chambers 53*a* and 53*b* are angled or formed "diagonally" between injection well 52 and each of wells 50 or 51. An aspect of the present invention is to create an upwardly inclined solvent fluid chamber for each pair of injection and production wells (e.g. 50 and 52 or 51 and 52), the upwardly inclined solvent fluid chambers each delimited by upper and lower upwardly inclined boundaries which tend to converge towards the upper well (e.g. 50).

The conditions under which this angled or diagonal solvent fluid chamber is formed between each pair of injection and production wells will depend on the specific reservoir conditions, such as horizontal and vertical permeability as well as the viscosity of the heavy oil in the deposit or reservoir. In other words, the reservoir conditions will determine or dictate the injection or production pressures and rates as well as pressure gradients through which the solvent fluid chambers of the present invention are formed and maintained. The conditions that will likely determine the formation of the solvent fluid chamber in accordance with the present invention include the rates and pressures at which a solvent fluid may be injected into a deposit, the horizontal and vertical permeability of a deposit, the rate or pressure of production at the producing wells and the pressure differential between the injection and production wells. The flow rate of fluid through a permeable matrix is proportionate to the permeability and inversely proportionate to the viscosity of the fluid. Hence, high permeability and low viscosity oil will result in and require high injection and production rates. In order to direct the creation, formation or maintenance of the upwardly inclined diagonal fluid chamber, the injected fluid must be forced or driven towards the production well and should not be allowed to rise or gravity override to the top of the reservoir as shown in FIG. 1(*b*). In other words, the viscous forces created by pressure differentials and high flow rates should overcome or dominate the gravity or buoyancy force of the lighter injected solvent fluid. It will be understood that as the horizontal and vertical permeability of the deposit increases and/or the viscosity of the heavy oil located therein decreases, the ability of the solvent fluid to transverse the deposit will increase. To avoid a gravity overriding solvent chamber, as described herein, the creation, formation or maintenance of the solvent fluid chamber should be directed by increasing or maximizing the injection rate at the injection well and increasing or maximizing the production rate at the production wells to accommodate the permeability and viscosity conditions of the deposit.

In general, the solvent fluid injection rate should be as much or as fast as possible given the horizontal and vertical permeability of the deposit as well as the viscosity of the heavy oil (i.e. heavy oil and bitumen) deposited therein. Injection rates will generally be high if the horizontal or vertical permeability is high and/or the viscosity of the heavy oil is low and vice versa. In other words, the higher the permeability, the higher the injection rate; conversely, solvent fluid injection rates tend to be lower the higher the viscosity of the heavy oil in the deposit or reservoir if the horizontal and vertical permeability of the deposit is high (e.g. generally exceeding 500 millidarcies (mD)), the injection rate should be correspondingly high. Similarly, the production rate at the producing wells should be as high as possible given a particular horizontal and vertical permeability of a given deposit and the viscosity of the heavy oil deposited therein.

By injecting the solvent fluid at a sufficiently high rate as noted herein and producing the reservoir fluid at a sufficiently high rate as noted herein, a pressure gradient is created so as to direct flow of the solvent fluid towards the production wells away from the injection wells to create an angled or diagonal solvent fluid chamber of the type or geometry as described herein. This directed flow arises because the solvent fluid channels through deposit 49 to create the solvent fluid chamber of the disclosed configuration or geometry. The solvent fluid channelling or preference direct flow arises because the solvent fluid, particularly when it is a gas, will tend to move or "channel" through the deposit due to the pressure differential created between the injection and production wells.

It will be understood that the actual or specific injection and production rates may not be a significant factor as each will likely depend on the reservoir conditions. The directed formation of the solvent fluid chamber of the desired configuration or geometry may be more influenced by the creation of a pressure gradient or pressure difference between the injection and production wells. Subject to equipment tolerances, the injection rates and/or production rates should be as high as possible under specific reservoir conditions.

Figure 6:
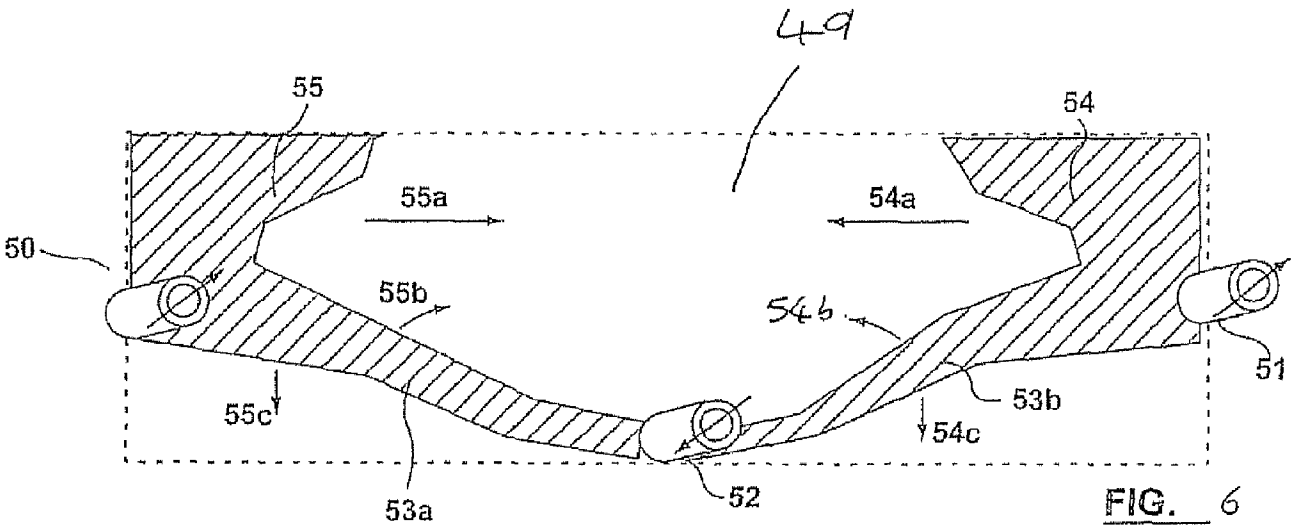
FIGS. 6 and 7 are schematic end views of horizontal wells for use with embodiments of the present invention.
Figure 7:
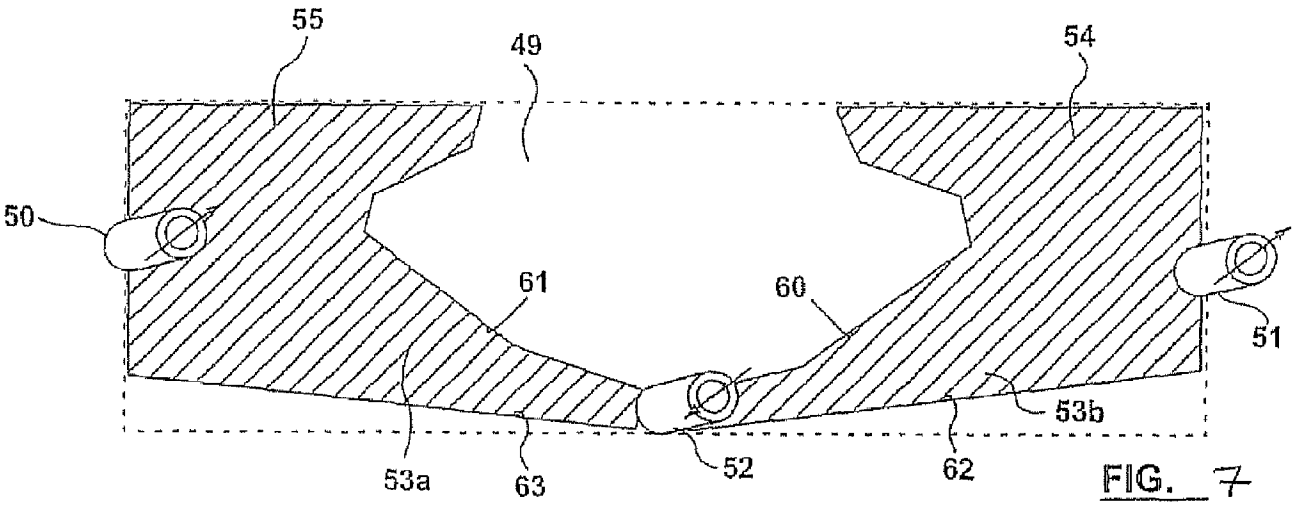

As shown in FIGS. 5 to 7, the solvent fluid injected into the deposit 49 via well 52 will tend to channel towards wells 51 and 50 to form two angled or diagonal solvent fluid chambers 53*a* and 53*b*. As noted above, the specific conditions under which the angled or diagonal solvent fluid chambers can be created will vary for each reservoir depending on the reservoir conditions. In order to form diagonal solvent fluid chambers, such as chamber 53*a* between wells 50 and 52, as well as chamber 53*b* between wells 51 and 52, the rate at which the solvent fluid can be injected into well 52 should preferably be as high as possible so that injected solvent fluid directly channels through the heavy oil to wells 50 and 51, respectively. Injection of the solvent fluid into well 52 must be at rates sufficiently high to induce solvent fluid channelling of the injected solvent fluid. Such injection rates may be greater than 14,000 standard cubic meters per day (500,000 standard cubic feet per day). It is also important to produce wells 50 and 51 at the highest rates as possible so as to produce the desired pressure gradient. As such, an embodiment of the present invention provides for a pressure gradient exceeding 100 kPa up to a maximum not exceeding the fracture pressure of the formation (e.g. when the deposit or reservoir breaks apart) for heavy oil. It may even be necessary to exceed the fracture pressure if the viscosity is particularly high, such as for bitumen.

If injection rates, production rates and pressure gradients are not sufficiently high for a given reservoir, the injected solvent fluid will preferentially rise to the top of the reservoir due to its natural buoyancy and form a solvent fluid chamber as shown in FIGS. 1(*a*) and 1(*b*). Such a solvent fluid chamber is known as a gravity overriding solvent chamber. An additional benefit of sufficiently high solvent fluid injection rates, high production rates and high pressure gradients between the wells is that solvent fluid injection and the diagonal solvent fluid chamber should occur along most of the length of the horizontal well. At low rates and low pressure gradients between the wells, the solvent fluid injection and chamber formation may only occur along less than 50% of the length of the horizontal well resulting in low rates of oil production. However, the present invention provides for solvent fluid chamber formation in greater than 50% the length of the horizontal well.

As shown in FIG. 5, solvent fluid chambers 53*a* and 53*b* having the desired configuration and geometry can be formed between injection well 52 and production wells 50 and 51 upon solvent fluid breakthrough at wells 50 and 51. As such, well 52 is in solvent fluid contact with wells 50 and 51. Once the solvent fluid has reached wells 50 and 51 so as to establish the angled or diagonal fluid chambers 53*a* and 53*b*, wells 50 and 51 are switched from production of reservoir fluid to injection of solvent fluid into deposit 49. Upon solvent fluid breakthrough, well 52 can be simultaneously switched from injection of solvent fluid to production of reservoir fluid, including improved viscosity heavy oil and solvent fluid. As shown in FIGS. 6 and 7, solvent fluid can be injected into deposit 49 via wells 50 and 51 while reservoir fluid is produced at well 52. In doing so, additional solvent fluid chambers 55 and 54 are formed. Reservoir fluid, including decreased viscosity heavy oil or production oil and solvent fluid is then produced from well 52. As shown in FIGS. 6 and 7, solvent fluid is continuously injected into wells 50 and 51 such that solvent fluid chambers 53*a*, 53*b*, 54 and 55 expand in the directions of arrows 54*a,b,c* and 55*a,b,c* (see FIG. 6), such that reservoir fluid can be produced from well 52. Eventually, continuous solvent fluid injection into wells 50 and 51 and continuous production from well 52 can occur until the deposit has had a significant portion, such as 20-80%, of the heavy oil extracted.

It will be understood that some or all these steps can then be repeated if, for example, (a) if the solvent chamber configuration or geometry is not achieved or is lost (e.g. converts to a gravity overriding solvent chamber) due to equipment failure or the process stopped for whatever reason and the solvent fluid chamber needs to be re-created; or (b) the configuration, geometry or size of the solvent fluid chamber need to be optimized (e.g. not extending greater than 50% the length of the horizontal well). It will be understood that prior to production at wells 50 and 51, solvent fluid injection into these wells can be done, particularly in the presence of reservoirs with high bitumen content.

Unlike prior art methods, such as those shown in FIGS. 1(*a*) and 1(*b*), the above noted embodiment of the present invention provides for an increase in the recovery of heavy oil contained in deposit 49. As noted above, the rate of heavy oil recovery will be dependent on the mixing of the solvent fluid within the solvent fluid chamber and the heavy oil, namely the "fluid/oil mixing rate". Unlike the prior art methods noted in FIGS. 1(*a*) and 1(*b*), this embodiment of the present invention provides for both "fluid over oil" surface area mixing as well as "oil over fluid" surface area mixing. Gravity overriding solvent fluid chambers 15 and 41 of FIGS. 1(*a*) and 1(*b*) provide only "fluid over oil" surface area mixing. This is in contrast to solvent fluid chambers having the desired configuration or geometry taught herein as shown in FIGS. 5 to 7. As shown in FIG. 7, the diagonal solvent fluid chambers have two areas of solvent fluid and oil surface area mixing, namely upper surfaces 60, 61 and lower surfaces 62, 63 of solvent fluid chambers 53*a* and 53*b*. "Fluid over oil" mixing will occur at lower surfaces 62 and 63 of solvent fluid chambers 53*a* and 53*b*, respectively. Similarly, there will be "fluid over oil" surface area mixing along the lower surfaces 62 and 63 of solvent fluid chambers 54 and 55. In addition to the "fluid over oil" mixing occurring at those surfaces, there will also be "oil over fluid" surface area mixing at the upper surfaces 60 and 61 of solvent chambers 53*a* and 53*b*. As such there will be increased mixing in the "diagonal" solvent fluid chambers of the present invention over the methods known in the prior art. The increased solvent fluid and oil mixing will result in a higher production at well 52.

Eventually, continuous solvent fluid injection into horizontal wells 50 and 51 and continuous production from horizontal well 52 can occur until deposit or reservoir 49 has had a significant portion, such as 20 to 80% of the heavy oil extracted. Likewise, injection rates into the horizontal wells can be adjusted to maximize the recovery of heavy oil. If injection and production rates are too low, a gravity overriding chamber could form, reducing the recovery of heavy oil. Injection and production rates must be sufficiently high to maintain the diagonal or directed chamber. If injection rate is too high, more solvent may break through and may need to be re-injected and re-cycled. It will be understood that as heavy oil is being extracted from the area surrounding wells 50, 51 and 52, then extracting using the process noted above can concurrently or subsequently be implemented to other existing or infill drilled horizontal wells (not shown) within reservoir 49.

As the present invention provides for the creation of an angled or diagonal solvent fluid chamber between an injection horizontal well and an offset producing horizontal well, it will be understood that factors that may impact the solvent fluid channelling through the deposit may have an impact on the process of the invention. For example, in formations where bottom water is present, the presence of bottom water may assist in the formation of the diagonal solvent fluid chamber due to the increased mobility of the solvent fluid through the water at the top of the oil-water transition zone.

Solvent Fluid Chamber Creation Using Horizontal and Vertical Wells

As shown in FIGS. 8 to 12, another embodiment of the present invention provides for the use of horizontal and vertical production and injection wells to direct the formation of solvent fluid chambers having a desired geometry or configuration. Instead of using horizontal wells only, this embodiment involves recovery using vertical injection/production wells as well as horizontal injection/production wells. This embodiment involves directing and maintaining the creation or development of a solvent fluid chamber having a desired geometry or configuration between offset vertical injection and production wells with horizontal production and injection wells through the use of simultaneous solvent fluid injection and reservoir fluid production between the offset vertical and horizontal wells and alternating the injection and production between them.

As with the other embodiment of the present invention, the objective of this embodiment is to obtain improved mixing of solvent fluid with heavy oil so as to reduce the viscosity of an increased amount of heavy oil allowing decreased viscosity heavy oil or production oil to be produced. Instead of using horizontal wells only, this embodiment involves recovery or production using vertical injection or production wells. This embodiment involves the creation of a solvent fluid chamber between vertical injection and production wells and with offset horizontal production and injection wells.

In the heavy oil reservoir with or without existing vertical wells, the configuration or geometry of the solvent fluid chamber is determined by use of alternating the injection of solvent fluid and the production of reservoir fluid, containing production oil, through the use of vertical and horizontal wells. For example, vertical wells can be drilled (if no existing vertical wells) and, offset to these vertical wells, parallel horizontal producing wells can be drilled (if no pre-existing wells) close to the bottom of the formation (e.g. within 1 meter). In this embodiment, a solvent fluid chamber is first established between the vertical injection wells. This is accomplished by injecting solvent fluid and producing reservoir fluid simultaneously between paired vertical wells. For example, solvent fluid can be injected into a first vertical well while producing a second vertical well until significant solvent fluid breakthrough occurs. Solvent fluid can also be injected next into the first and second vertical well while producing from an offset third vertical well for a desired time. This process is continued until a solvent fluid chamber has the desired geometry or configuration. Solvent fluid can then be injected into a horizontal well at pressures higher than at the vertical wells so as create a second solvent fluid chamber, thus reducing the viscosity of the surrounding heavy oil. Solvent fluid can be injected into the vertical wells and reservoir fluid, and then production oil, can be produced from the horizontal wells until depletion of the reservoir.

As shown in FIGS. 8 to 12, there are existing or infill drilled vertical wells 100, 102, 104, 106, 108 and 110 in a typical spatial arrangement of vertical production and injection wells within reservoir or deposit 90. It will be understood that the injection pattern can be selected based on the location of existing wells, reservoir size and shape, cost of new wells and the recovery increase associated with the various possible injection or production patterns. Common injection patterns are direct line drive, staggered line drive, two-spot, three-spot, four-spot, five-spot, seven-spot and nine-spot.

Figure 8:
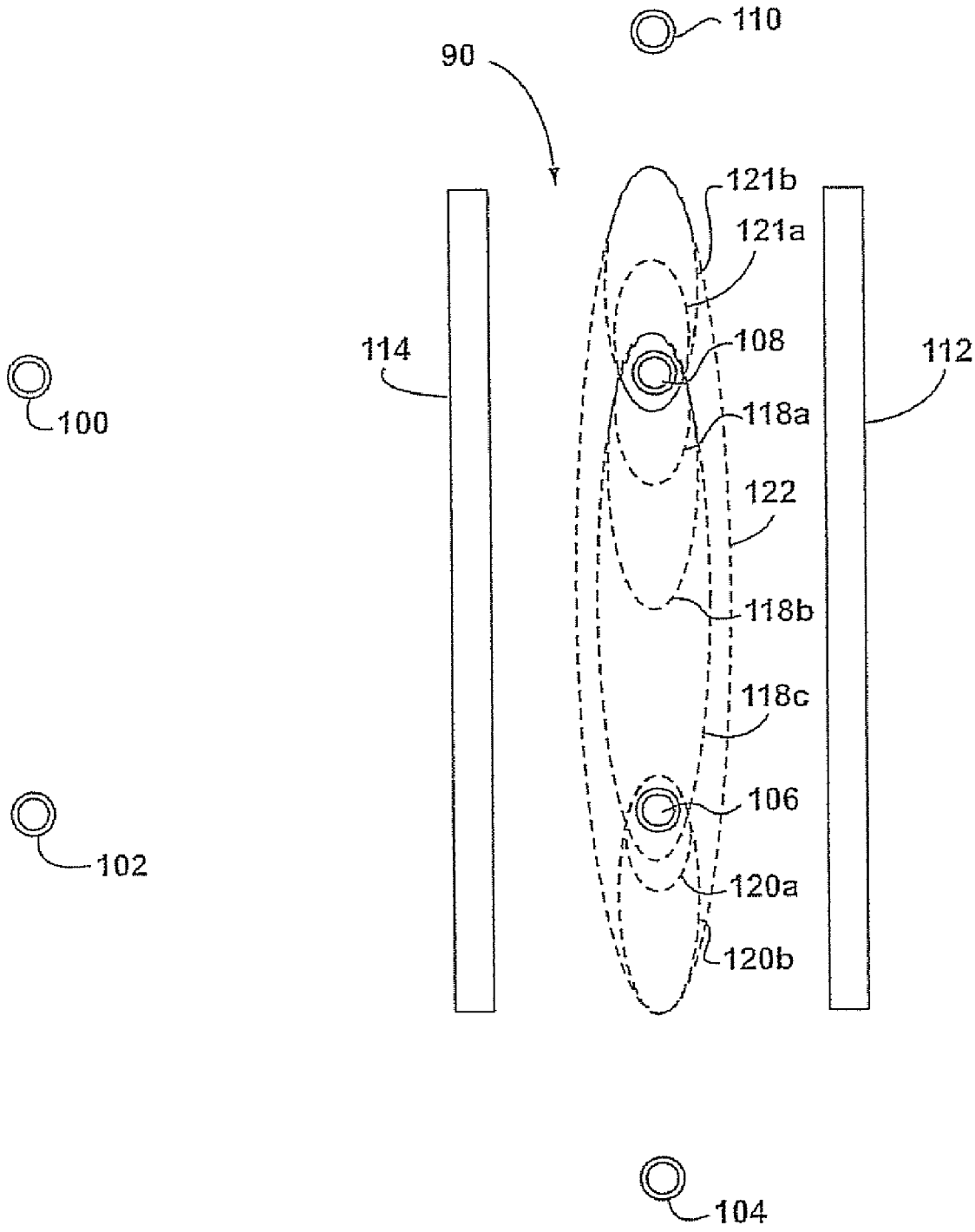
FIGS. 8 to 10 are schematic plan views of horizontal and vertical wells for use with embodiments of the present invention.

Solvent fluid can be first injected into deposit 90 through vertical well 108. Simultaneously, reservoir fluid is produced at vertical well 106. For reasons noted above, this will induce the formation of solvent fluid chamber 118*a*, as shown in FIG. 8. As the solvent fluid is injected into reservoir 90 through well 108 while reservoir fluid is produced at well 106, solvent fluid chamber 118*a* will expand to 118*b* and eventually 118*c*, at which point solvent fluid breakthrough can occur. As a result, a continuous solvent fluid chamber 118*c* is created between wells 108 and 106. As noted above with respect to solvent fluid chamber 53*a*, solvent fluid chamber 118*c* has a generally conical shape preferentially distorted in the direction of well 106. The generally conical shape of solvent fluid chamber 118*c* is oriented in the vertical direction with its longitudinal axis parallel to the vertical axis of well 108. The conical apex of solvent fluid chamber 118*c* is generally oriented away from the upper portion of vertical well 108 and deposit 90 and points towards the lower portion of vertical well 108 and deposit 90, while the conical base is generally oriented towards the upper portion of well 108 and deposit 90. The conical base is generally widest nearest the upper portion of injection well 108 as this area tends to have the highest concentration of solvent fluid. As the process described herein proceeds, solvent fluid chamber 118*c* will expand both at the conical base and the conical apex outwardly from vertical well 108 as more solvent fluid is injected. It will be understood however, that the specific configuration or geometry of solvent fluid chamber 118*c* will be dictated by reservoir conditions.

As noted previously, the solvent fluid injection rate at 108 and reservoir fluid production rate at well 106 must be sufficiently high for the solvent fluid to channel as directly as possible from well 108 towards well 106 possibly at solvent fluid injection rates exceeding 3,000 standard cubic meters per day (100,000 standard cubic feet per day). It is also important that the pressure gradient between 108 and 106 be very high as possible, possibly exceeding 100 kPa pressure. The solvent fluid breakthrough and flow between these vertical wells must be enough in volume and time to create a stable and reasonable sized solvent fluid chamber 118*c*. The solvent fluid breakthrough and cycling time between these wells should be one or more months long. The reservoir conditions (e.g. net oil pay, porosity and permeability) and field application (e.g. distance between wells and injection and productions rates) will determine the solvent fluid injection rate, volume and time.

If solvent fluid breakthrough does not occur then one or more infill vertical wells between wells 106 and 108 can be drilled (not shown). It will be understood that several reasons could account for the failure of the solvent fluid to break through, such as reservoir discontinuity, geological barriers, poor permeability or the inter-well distance is too great due to the high viscosity of the heavy oil. For example, if an infill vertical well was made between wells 106 and 108, solvent fluid injection could continue at well 108 with simultaneous reservoir fluid production from newly infill drilled adjacent vertical well until significant solvent fluid breakthrough occurs at the newly infill drilled adjacent vertical well. Once solvent breakthrough occurs at the newly infill drilled adjacent vertical well, solvent fluid injection can cease at vertical well 108 while the newly infill drilled adjacent vertical well switches from production to injection of solvent fluid. The solvent fluid can then be injected into the newly infill drilled adjacent vertical well while producing from next adjacent well such as vertical well 106 until solvent fluid breakthrough occurs at well 106.

Following solvent fluid breakthrough at well 106, solvent fluid injection at well 108 continues while well 106 is converted from production to solvent fluid injection. In other words, vertical well 106 is used to inject solvent fluid into fluid chamber 118*c*. Production is switched to vertical wells 104 and 110. For the reasons noted above, a pressure gradient will be created through which the solvent fluid chamber 118*c* will expand towards wells 110 and 104. As with the solvent fluid chamber development between 106 and 108, solvent fluid injection rates, reservoir fluid production rates and the pressure gradient between the injection and production wells must be sufficiently high for the solvent fluid to channel from 106 towards 104 and from 108 towards 110. As shown in FIG. 8, solvent fluid chamber 121*a* is created by the simultaneous production of reservoir fluid at well 110 and the injection of solvent fluid at well 108. As this simultaneous production and injection proceeds, solvent chamber 121*a* expands to 121*b*. Similarly, solvent fluid chamber 120*a* is created by the simultaneous production of reservoir fluid at well 104 and the injection of solvent fluid at well 106. As this simultaneous production and injection proceeds, solvent chamber 120*a* expands to 120*b*. It is not necessary for solvent fluid chambers 121*b* and 120*b* to extend to the point of solvent breakthrough at wells 110 and 104 respectively. Typically, the elongated gas chambers around the vertical wells should be slightly greater in length than the adjacent horizontal wells. However, it will be understood that the process could proceed until solvent fluid breakthrough occurs at wells 110 or 104. As shown in FIG. 8, simultaneous injection and production at wells 104, 106, 108 and 110 as noted above results in the formation of solvent fluid chamber 122.

Once the solvent fluid chamber 122 has between established, injection of solvent fluid into these wells and into the solvent fluid channels and chamber is similar to injecting solvent fluid into a hypothetical horizontal well extending between these wells and along the solvent fluid channel. Simply, the vertical wells in conjunction with the solvent fluid channel and chamber should act like a horizontal well. Unlike horizontal well injection, the injection and production rates can be adjusted between the vertical wells providing some control over the injection profile into the solvent fluid chamber and its composition. When solvent is injected into a horizontal well, most of the solvent could preferentially enter the reservoir in certain parts of the horizontal well bore resulting in a poor uneven injection profile. If 2-4 vertical wells act as a horizontal well, having control over the injection of each vertical well provides some control over the injection profile into the solvent chamber.

Figure 9:
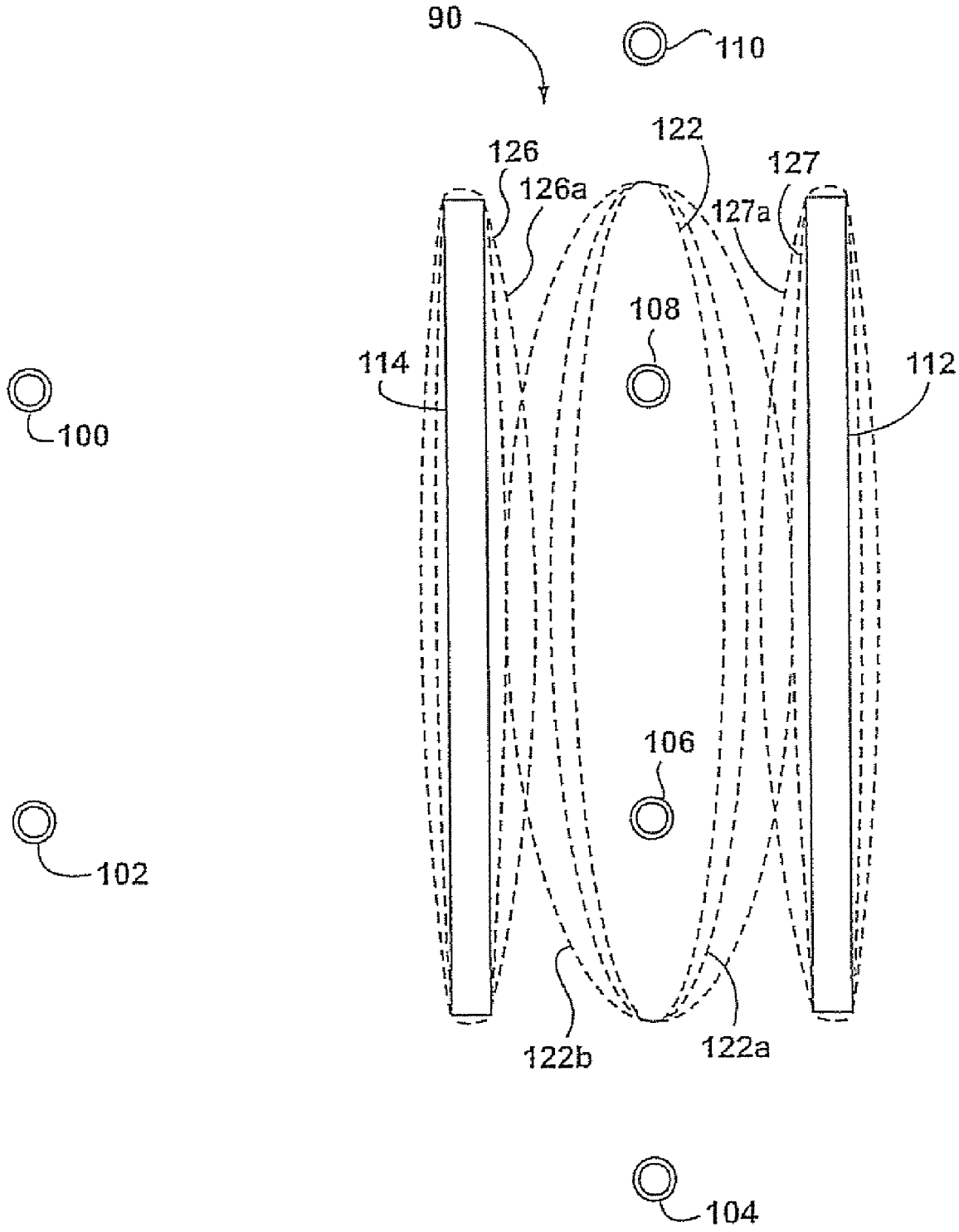

Upon formation of solvent fluid chamber 122 as shown in FIG. 9, solvent fluid can then be injected into new or previously existing horizontal wells 112 and 114 either simultaneously or alternately (e.g. inject solvent into 112 and shut in or produce 114 then inject into 114 and shut in or produce 112) at injection pressures higher than the reservoir pressures at vertical wells 106 and 108, and the reservoir pressure of solvent fluid chamber 122 between 106 and 108, as it will be understood that the reservoir pressures at wells 106 and 108 or in chamber 122 may not be the same. As described above in reference to FIG. 3, it will be understood that the horizontal wells 112 and 114 may include completion and production strings. In addition, the completion strings may be provided with flow control devices as discussed above. The injection pressures and/or rates at horizontal wells 112 and 114 should be as high as possible as noted above in order to direct the injected solvent fluid to channel laterally outwards from horizontal wells 112 and 114 towards vertical wells 106 and 108, respectively and solvent fluid chamber 122, as shown in FIG. 9. If there is no production at wells 108 and 106, the only pressure forcing the solvent fluid chamber to expand is the injection pressure from wells 112 and 114. However, there can be injection or production at wells 106 and 108, if needed, depending on reservoir conditions to create the solvent fluid chamber having the desired configuration. In addition to the pressure or rates being sufficiently high to direct the formation of horizontal solvent fluid chambers 126 and 127 laterally towards vertical fluid chamber 122, the solvent fluid injection pressures or rates must also be sufficient to create these solvent fluid chambers along most (e.g. greater than 50%) of the longitudinal length of each of horizontal wells 112 and 114. As shown in FIG. 9, horizontal wells 112 and 114 inject solvent fluid into reservoir or deposit 90 to create horizontal solvent fluid chambers 126 and 127. Solvent fluid chambers 126 and 127 are generally fusiformed or spindle shaped but distorted laterally and upwards along the horizontal axis of wells 112 and 114.

Figure 10:
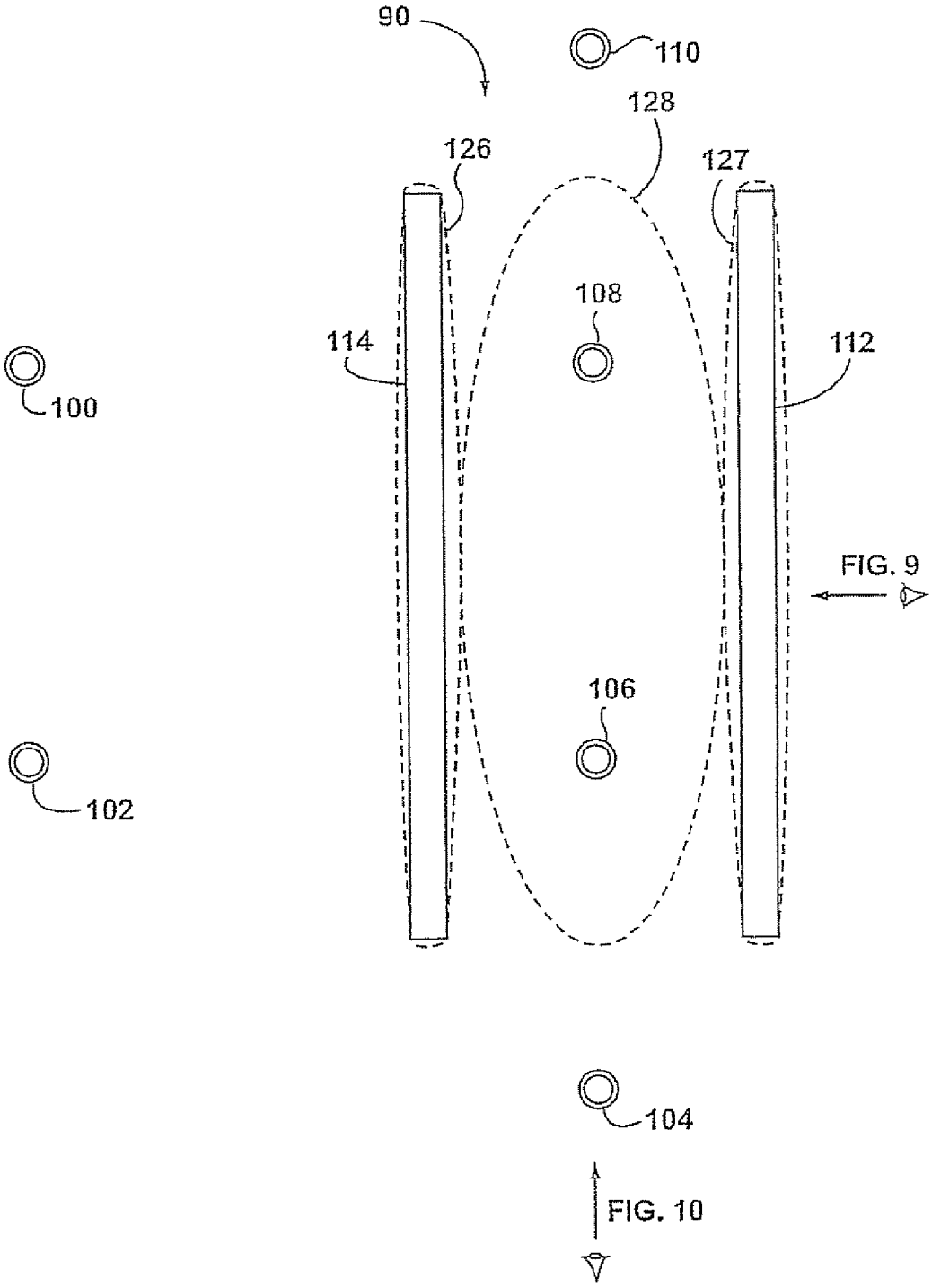

Horizontal wells 112 and 114 are then converted to production of reservoir fluid, while vertical wells 106 and 108 continue to inject solvent fluid into solvent fluid chamber 122. For the reasons noted herein, a pressure gradient will be created through which the solvent fluid chamber 122 will expand laterally towards wells 112 and 114, as shown in FIGS. 8 and 9. As with the solvent fluid chamber development between the vertical wells, fluid injection rates, reservoir fluid production rates and the pressure gradient between the vertical injection wells 106 and 108 as well as the horizontal production wells 114 and 112 must be sufficiently high for the solvent fluid to channel from existing solvent fluid chamber 122 towards horizontal solvent fluid chambers 126 and 127. As shown in FIG. 9, solvent fluid chamber 122 expands laterally into 122*a* due to the simultaneous production of reservoir fluid at wells 112 and 114 and the injection of solvent fluid at wells 106 and 108. As this simultaneous production and injection proceeds, solvent chambers 122*a*, 126 and 127 expand to 122*b*, 126*a* and 127*a*, respectively. This process continues until the expanding solvent fluid chamber 122, 122*a* and 122*b* converge with the expanding solvent fluid chambers 126, 126*a*, 127 and 127*a*. As shown in FIG. 10, solvent fluid chamber 128 is in solvent fluid connection with fluid chambers 126 and 127.

Figure 11:
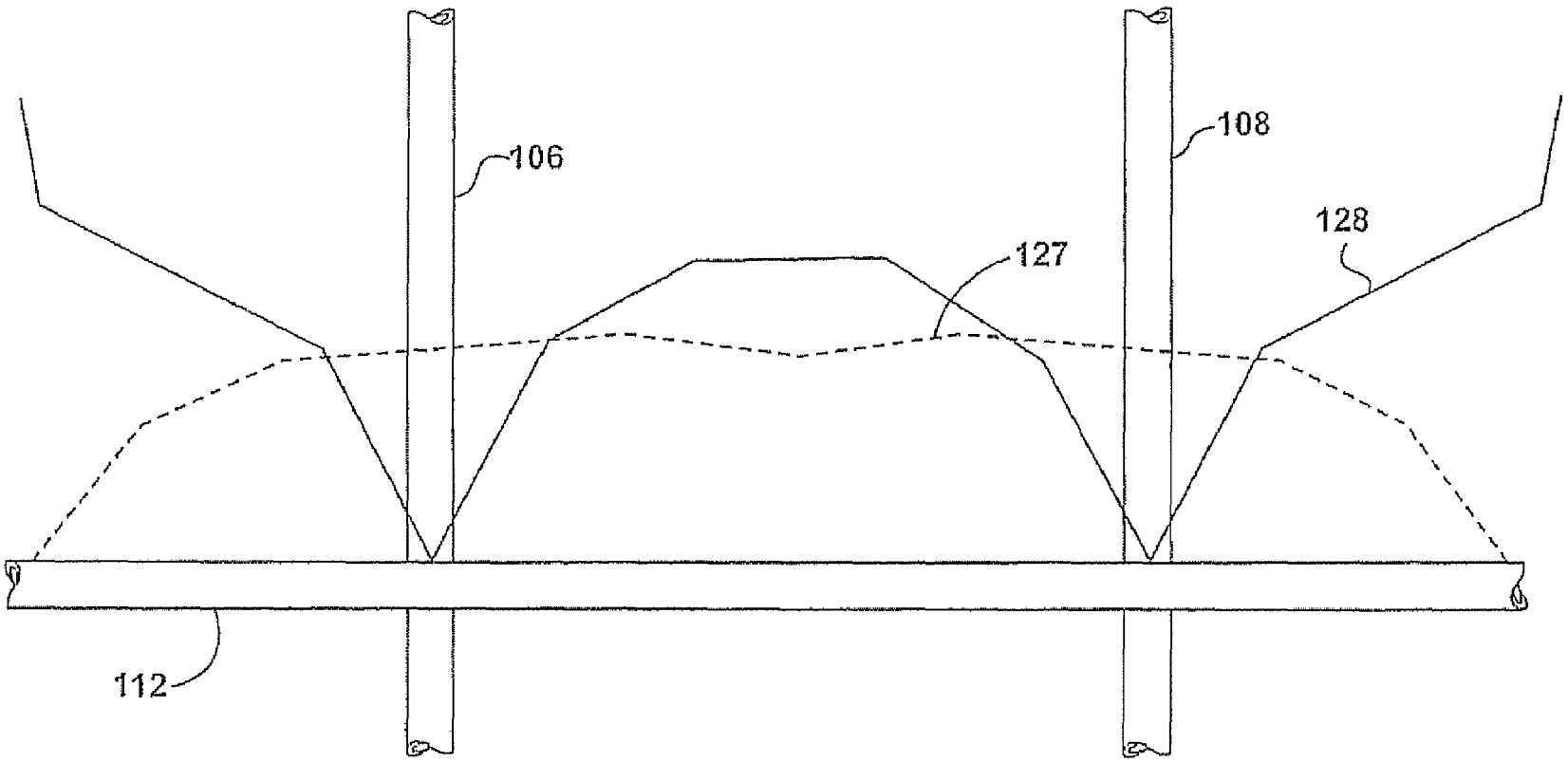
FIG. 11 is a schematic side view of horizontal and vertical wells for use with embodiments of the present invention.
Figure 12:
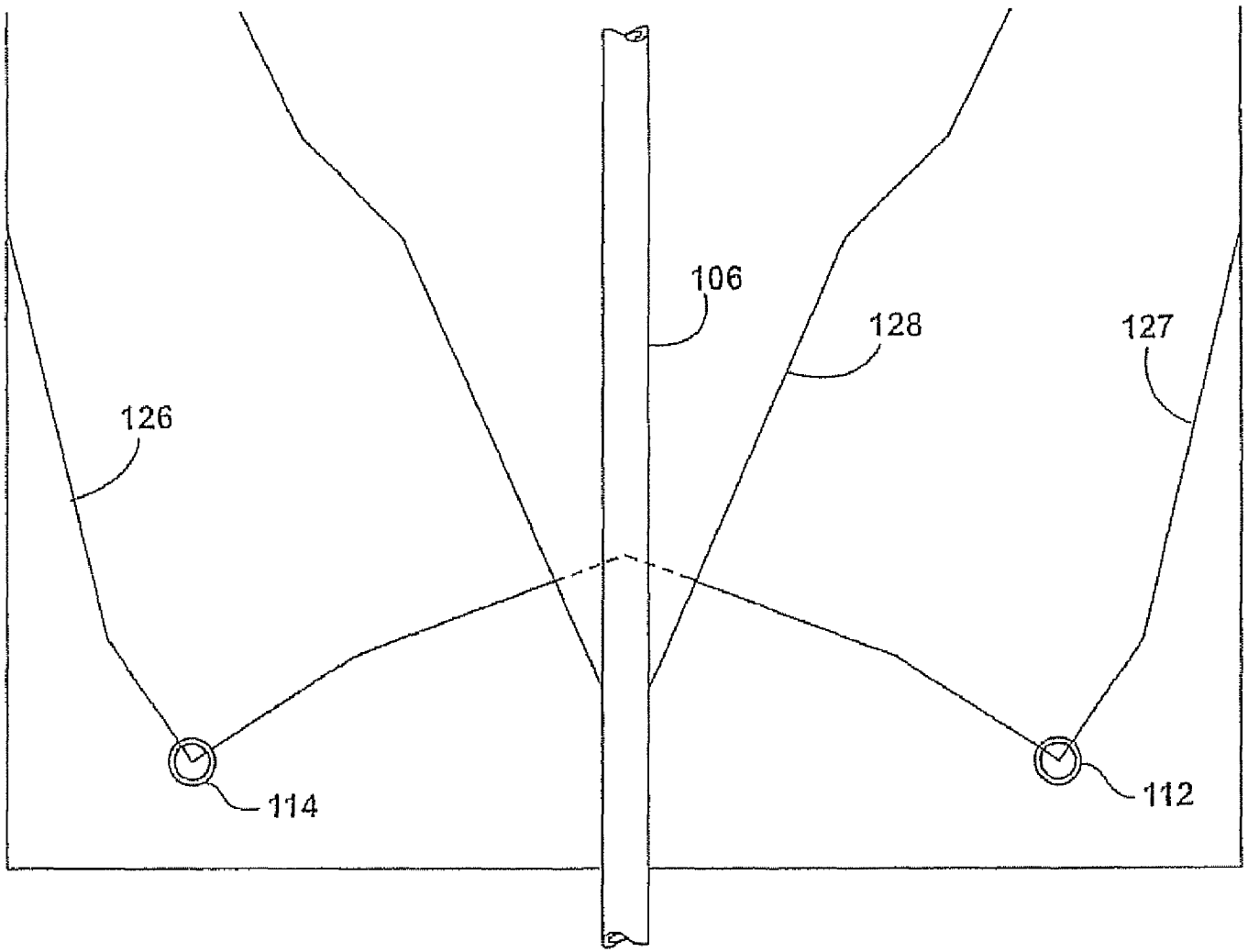
FIG. 12 is a schematic end view of horizontal and vertical wells for use with embodiments of the present invention.

FIGS. 11 and 12 provide cross-sectional views of the configuration or geometry of the solvent fluid chambers 127 and 128. It will be understood that a cross-sectional view of fluid chamber 126 and 128 would be the same as seen in FIG. 11; therefore only the solvent fluid chamber at 127 and 128 will be described. As seen in FIG. 11, elongated solvent fluid chambers in fluid connection are formed at each of vertical wells 106 and 108. While it will be understood that the specific configuration or geometry of solvent fluid chamber 128 will be dictated by reservoir conditions, it is seen in FIG. 11 as two generally conical shaped solvent fluid chambers as described above. As noted above, solvent fluid chamber 127 is generally fusiformed or spindle shaped along the horizontal axis of well 112. As seen in FIG. 12, two angled or diagonal solvent fluid chambers in fluid connection are formed at each of horizontal wells 112 and 114.

It will be understood that some or all these steps can then be repeated if, for example, (a) the solvent chamber configuration or geometry is not achieved or is lost (e.g. converts to a gravity overriding solvent chamber) due to equipment failure or process stoppage for any reason and the solvent fluid chamber needs to be re-created; or (b) the configuration, geometry or size of the solvent fluid chamber need to be optimized (e.g. create more solvent fluid chamber along the horizontal well, creating more of a solvent fluid chamber between the vertical wells or changing the composition of the solvent).

Eventually, continuous solvent fluid injection into vertical wells 106 and 108 and continuous production from horizontal wells 112 and 114 can occur until deposit or reservoir 90 has had a significant portion, such as 20-80%, of the heavy oil extracted. Likewise, injection rates into the vertical wells can be adjusted to maximize the recovery of heavy oil and bitumen. It will be understood that as the heavy oil is being extracted from the area surrounding vertical wells 106 and 108 as well as horizontal wells 112 and 114, then extracting using the process noted above can concurrently or subsequently be implemented to wells 100 and 102 or others within the area of reservoir 90.

Although the invention has been described with reference to certain specific embodiments, various modifications thereof will be apparent to those skilled in the art without departing from the purpose and scope of the invention as outlined in the claims appended hereto. Any examples provided herein are included solely for the purpose of illustrating the invention and are not intended to limit the invention in any way. Any drawings provided herein are solely for the purpose of illustrating various aspects of the invention and are not intended to be drawn to scale or to limit the invention in any way. The disclosures of all prior art recited herein are incorporated herein by reference in their entirety.

| Step | Rate | Pressure | Duration | Expected Results |
|---|---|---|---|---|
| 1a - Inject solvent into well 52 until significant solvent breakthrough to wells 50 & 51 | Very high rates, possibly exceeding 28,000 standard m3/d | Highest injection pressures in excess of 100 kPa above reservoir pressure | Roughly 1 month | Significant gas channelling occurring from well 52 to 50 and from well 52 to 51 |
| 1b - Simultaneously with step 1a produce reservoir fluids from wells 50 & 51 and solvent as it channels from well 52 | Very high rates | Highest production drawdown at inflow pressures in excess of 100 kPa below reservoir pressure | Roughly simultaneously with step 1a | Oil production along with significant gas channelling occurring from well 52 to 50 and from well 52 to 51 |
| Step 2a - Inject solvent in wells 50 & 51 until significant solvent production occurs at well 52 | Very high rates, possibly exceeding a total of 28,000 standard m3/d | Highest injection pressures in excess of 100 kPa above reservoir pressure | Roughly 1 month | Significant gas channelling occurring from well 50 to 52 and from well 51 to 52 |
| 2b - Simultaneously with 2a produce reservoir fluids and solvent from well 52 and more solvent as it channels from wells 50 & 51 | Very high rates | Highest production drawdown at inflow pressures in excess of 100 kPa below reservoir pressure | Roughly simultaneously with step 2a | Oil and some solvent production along with significant gas channelling occurring from well 50 to 52 and from well 51 to 52 |
| 3+ - Repeat steps 1a, 1b, 2a and 2b numerous times until wells 50 & 51 produce less oil than well 52 and too much gas | Very high rates | As above | Roughly 1 month for each step | Oil and solvent production with significant gas channelling with diagonal chamber growth in size and along most of the horizontal lengths of each well |

-continued

| Step | Rate | Pressure | Duration | Expected Results |
|---|---|---|---|---|
| 4 - Continuously inject solvent into wells 50 & 51 and continuously produce oil and solvent from well 52 | At maximum oil production rate and minimum solvent gas recycling | At drawdown pressures that maximize oil production and minimize gas recycling | Continuously until depletion of the reservoir | Oil production, solvent production |

Example 2

Producing Heavy Oil by Creating and Maintaining Solvent Chambers Using Horizontal Producing Wells & Vertical Injection Wells

| Step | Rate | Pressure | Duration | Expected Results |
|---|---|---|---|---|
| 1a - Inject solvent into vertical (vt.) well 108 until significant solvent breakthrough to vt. well 106 | Very high rates, possibly exceeding 14,000 standard m3/d | Highest injection pressures in excess of 100 kPa above reservoir pressure | Roughly 1 month or until a significant and stable gas channel forms | Significant gas channelling occurring from well 108 to 106 and forming a stable gas channel with high gas saturation |
| 1b - Simultaneously produce reservoir fluids from well 106 and solvent as it channels from well 108 | Very high rates | Highest production drawdown at inflow pressures in excess of 100 kPa below reservoir pressure | Roughly simultaneously with step 1a | Oil production along with significant gas channelling occurring from well 108 to 106 as described above |
| 2 - Inject solvent in wells 108 & 106 while producing reservoir fluid from wells 110 and 104 so as to channel gas towards 110 and 104 | Very high rates, possibly exceeding a total of 28,000 standard m3/d | Highest injection pressures in excess of 100 kPa above reservoir pressure | Roughly 0.5-1 month. Injection time to be more than half the breakthrough time in step 1a | Significant gas channelling occurring from well 108 towards 110 and from well 106 towards 104. inject for a time longer than half the breakthrough time measured in steps 1a and 1b |
| 3 - Inject solvent in horizontal (hz.) wells 112 & 114 while wells 108 and 106 are preferably shut in but these wells could be producing | Very high rates, possibly exceeding a total of 28,000 standard m3/d | Highest injection pressures in excess of 100 kPa above the reservoir pressures at wells 108, 106 and their gas chamber pressure | Roughly 1 month | Significant gas channelling occurring from hz wells 112 and 114 towards the gas chamber around wells 106 and 108 |
| 4a - Produce reservoir fluids and solvent from hz wells 112 and 114 | Very high rates | Highest production drawdown at inflow pressures in excess of 100 kPa below reservoir pressure | Roughly 1 month | Oil and some solvent production |
| 4b - Inject solvent in wells 108 & 106 while producing reservoir fluid from wells 112 and 114 to channel gas toward 112 and 114 and expand the gas chamber around wells 108 & 106 | Very high rates, possibly exceeding a total of 28,000 standard m3/d | Highest injection pressures in excess of 100 kPa above reservoir pressure | Roughly simultaneously with step 4a | Significant gas channelling occurring from the gas chamber around wells 106 and 108 towards the gas chambers around wells 112 and 114 |
| 5+ - Repeat steps 4a and 4b numerous times until the gas chambers around the hz wells 112 and 114 significantly connects with the gas chamber around wells 106 & 106 | Very high rates | As above | Roughly 1 month for each step | Oil and solvent production from 112 and 114 with significant gas channelling with growth of the gas chamber along most of the horizontal lengths of each well and also growth of the gas chamber around wells 108 & 106. |
| 6 - Continuously inject solvent into wells 106 & 108 and continuously produce oil and solvent from hz wells 112 and 114 | At maximum oil production rate and minimum solvent gas recycling | At drawdown pressures that maximize oil production and minimize gas recycling | Continuously until depletion of the reservoir | Oil production, solvent production |

We claim:

1. A method for extracting hydrocarbons from a reservoir containing said hydrocarbons and having disposed therein at least one first well and at least one second well, each of the first wells having a first completion string disposed therein, and each of the second wells having a second completion string disposed therein, the first wells being positioned in a lower portion of the reservoir and the second wells being positioned vertically above and laterally offset from the first wells, the method comprising:

(a) injecting a solvent fluid into the reservoir through at least one of the first completion strings to cause gravity induced counter-flow mixing of the solvent fluid and the hydrocarbons within the reservoir;

(b) extracting reservoir fluid from the reservoir through at least one of the second completion strings to create a solvent fluid chamber extending between the at least one first well and the at least one second well;

(c) injecting solvent fluid into the reservoir through at least one of the second completion strings;

(d) extracting reservoir fluid from the reservoir through at least one of the first completion strings;

wherein at least one of the first and second completion strings includes two or more flow control devices located on a portion thereof in the reservoir for uniform injection of the solvent fluid into the reservoir or uniform extraction of reservoir fluid from the reservoir.

2. The method of claim 1, wherein the first and second wells are horizontal wells.

3. The method of claim 1, wherein the solvent fluid chamber is delimited by vertically inclined upper and lower boundaries.

4. The method of claim 3, wherein the upper and lower boundaries converge towards the at least one second well.

5. The method of claim 1, wherein the solvent fluid is a liquid, gas or a mixture thereof and the liquid or gas is selected from the group consisting of steam, methane, butane, ethane, propane, pentanes, hexanes, heptanes, and $CO_2$ and mixtures thereof.

6. The method of claim 1, wherein the hydrocarbons comprise heavy oil and/or bitumen.

7. The method of claim 1, wherein the extracting of reservoir fluid in step (b) is done concurrently with the solvent fluid injection of step (a).

8. The method of claim 1, wherein the extracting of reservoir fluid in step (d) is done concurrently with the solvent fluid injection of step (c).

9. The method of claim 1, wherein the steps (a) to (d) are repeated at least once.

10. The method of claim 1, wherein at least two of said second wells are provided for each first well, said second wells being horizontally spaced apart from each other, and wherein the solvent fluid chamber formed in step (b) extends from the first well to each of the second wells.

11. The method of claim 10, wherein two second wells are provided for each first well whereby said solvent fluid chamber is bi-directional, extending from the first well to each of said second wells.

12. The method of claim 1 wherein step (c) is commenced upon solvent fluid breakthrough at the second well in step (b).

13. The method of claim 1 wherein at least one of the extracting steps (b) or (d) utilizes a production string provided in or adjacent to the respective completion string.

14. The method of claim 1, wherein the solvent fluid chamber includes an upper "hydrocarbon over solvent fluid" surface and a lower "solvent fluid over hydrocarbon" surface.

15. A method for extracting hydrocarbons from a reservoir containing said hydrocarbons and having disposed therein at least one first well and at least one second well, each of the first wells having a first completion string disposed therein, and each of the second wells having a second completion string disposed therein, the first wells being positioned in a lower portion of the reservoir and the second wells being positioned vertically above and laterally offset from the first wells, the method comprising:

(a) injecting a solvent fluid into the reservoir through at least one of the first completion strings to cause gravity induced counter-flow mixing of the hydrocarbons and the solvent fluid within the reservoir;

(b) extracting reservoir fluid from the reservoir through at least one of the second completion strings to create a solvent fluid chamber extending between the at least one first well and the at least one second well;

(c) injecting solvent fluid into the reservoir through at least one of the second completion strings; and, (d) extracting reservoir fluid from the reservoir through at least one of the first completion strings.

16. The method of claim 15, wherein the first and second wells are horizontal wells.

17. The method of claim 15, wherein the solvent fluid chamber is delimited by vertically inclined upper and lower boundaries.

18. The method of claim 17, wherein the upper and lower boundaries converge towards the at least one second well.

19. The method of claim 15, wherein the extracting of reservoir fluid in step (b) is done concurrently with the solvent fluid injection of step (a).

20. The method of claim 15, wherein the extracting of reservoir fluid in step (d) is done concurrently with the solvent fluid injection of step (c).

21. The method of claim 15, wherein at least two of said second wells are provided for each first well, said second wells being horizontally spaced apart from each other, and wherein the solvent fluid chamber formed in step (b) extends from the first well to each of the second wells.

22. The method of claim 21, wherein two second wells are provided for each first well whereby said solvent fluid chamber is bi-directional, extending from the first well to each of said second wells.

23. The method of claim 15 wherein step (c) is commenced upon solvent fluid breakthrough at the second well in step (b).

24. The method of claim 15 wherein at least one of the extracting steps (b) or (d) utilizes a production string provided in or adjacent to the respective completion string.

25. The method of claim 15, wherein the solvent fluid chamber includes an upper "hydrocarbon over solvent fluid" surface and a lower "solvent fluid over hydrocarbon" surface.

* * * * *